US007841896B2

(12) United States Patent
Shaw et al.

(10) Patent No.: US 7,841,896 B2
(45) Date of Patent: Nov. 30, 2010

(54) SEALED COMPRESSION TYPE COAXIAL CABLE F-CONNECTORS

(75) Inventors: Glen David Shaw, Conway, AR (US); Terry L. Fleming, Little Rock, AR (US); Robert J. Chastain, Maumelle, AR (US)

(73) Assignee: DS Engineering, LLC, North Little Rock, AR (US)

( * ) Notice: Subject to any disclaimer, the term of this patent is extended or adjusted under 35 U.S.C. 154(b) by 0 days.

(21) Appl. No.: 12/380,327

(22) Filed: Feb. 26, 2009

(65) Prior Publication Data

US 2009/0170360 A1 Jul. 2, 2009

Related U.S. Application Data

(63) Continuation-in-part of application No. 12/002,261, filed on Dec. 17, 2007, now Pat. No. 7,513,795.

(51) Int. Cl.
*H01R 9/05* (2006.01)

(52) U.S. Cl. ..... 439/578; 439/583; 439/584; 439/585

(58) Field of Classification Search ..... 439/578, 439/583–585

See application file for complete search history.

(56) References Cited

U.S. PATENT DOCUMENTS

| | | | | |
|---|---|---|---|---|
| D148,897 | S | 3/1948 | Ward | |
| D181,302 | S | 10/1957 | Logan | |
| 2,858,358 | A | 10/1958 | Hawke | |
| 3,199,061 | A | 8/1965 | Johnson | |
| 3,373,243 | A | 3/1968 | Janowiak | |
| 3,375,485 | A | 3/1968 | Donohue | |
| 3,498,647 | A | 3/1970 | Schroder | |
| 3,512,224 | A | 5/1970 | Newton | |
| 3,522,576 | A | 8/1970 | Cairns | |
| 3,537,065 | A | 10/1970 | Winston | |
| 3,609,637 | A | 9/1971 | Cole | |
| 3,668,612 | A | 6/1972 | Nepovim | |
| 3,671,926 | A | 6/1972 | Nepovim | |
| 3,678,446 | A | 7/1972 | Siebelist | |
| 3,686,623 | A | 8/1972 | Nijman | |
| 3,710,005 | A * | 1/1973 | French | 174/89 |

(Continued)

FOREIGN PATENT DOCUMENTS

| | | |
|---|---|---|
| EP | 0542102 | 5/1993 |

(Continued)

*Primary Examiner*—Tho D Ta
(74) *Attorney, Agent, or Firm*—Stephen D. Carver

(57) ABSTRACT

Axially compressible, self-sealing, high bandwidth F-connectors for conventional hand tools for interconnection with coaxial cable. An internal, dual segment sealing grommet activated by compression provides a seal. Each connector has a rigid nut that is rotatably secured to a, tubular body. A rigid, conductive post coaxially extends through the connector. A post barbed end penetrates the cable within the connector. A tubular, metallic end cap is slidably fitted to a body shank, and thereafter forcibly compressed lengthwise during installation. The end cap has a ring groove for seating the enhanced grommet. The end cap can irreversibly assume any position, being held by end cap teeth. A tactile system comprising external convex projections on the body complemented by a resilient, external O-ring on the end cap aids installers who can properly position connectors with the sense of touch.

13 Claims, 15 Drawing Sheets

U.S. PATENT DOCUMENTS

| | | | |
|---|---|---|---|
| 3,740,453 | A | 6/1973 | Callaghan |
| 3,846,738 | A | 11/1974 | Nepovim |
| 3,879,102 | A | 4/1975 | Horak |
| 3,976,352 | A | 8/1976 | Spinner |
| D241,341 | S | 9/1976 | Oxley |
| 3,985,418 | A | 10/1976 | Spinner |
| 3,986,737 | A | 10/1976 | Krusche |
| 4,280,749 | A | 7/1981 | Hemmer |
| 4,329,540 | A | 5/1982 | Howarth |
| 4,525,000 | A | 6/1985 | Bachle |
| 4,583,811 | A | 4/1986 | McMills |
| 4,593,964 | A | 6/1986 | Forney, Jr. |
| 4,630,806 | A | 12/1986 | Dan |
| 4,648,684 | A | 3/1987 | Mattis |
| 4,684,201 | A | 8/1987 | Hutter |
| 4,698,028 | A | 10/1987 | Caro |
| 4,746,305 | A | 5/1988 | Nomura |
| RE32,787 | E | 11/1988 | Gallusser |
| 4,813,716 | A | 3/1989 | Lalikos |
| 4,834,675 | A | 5/1989 | Samchisen |
| 4,936,788 | A | 6/1990 | Lin |
| 4,952,174 | A | 8/1990 | Sucht |
| D313,222 | S | 12/1990 | Takizawa |
| 4,990,106 | A | 2/1991 | Szegda |
| 5,011,422 | A | 4/1991 | Yeh |
| 5,024,606 | A | 6/1991 | Ming |
| 5,043,696 | A | 8/1991 | Wang |
| 5,078,623 | A | 1/1992 | Wang |
| 5,088,936 | A | 2/1992 | Wang |
| 5,112,250 | A | 5/1992 | Wang |
| D327,872 | S | 7/1992 | McMills |
| 5,167,525 | A | 12/1992 | Wang |
| 5,167,536 | A | 12/1992 | Wang |
| 5,192,226 | A | 3/1993 | Wang |
| 5,219,299 | A | 6/1993 | Wang |
| 5,226,838 | A | 7/1993 | Hsu |
| D339,568 | S | 9/1993 | Salz |
| 5,270,487 | A | 12/1993 | Sawamura |
| 5,321,207 | A | 6/1994 | Huang |
| 5,340,325 | A | 8/1994 | Pai |
| 5,342,096 | A | 8/1994 | Bachle |
| 5,383,798 | A | 1/1995 | Lin |
| 5,387,116 | A | 2/1995 | Wang |
| 5,387,127 | A | 2/1995 | Wang |
| 5,389,012 | A | 2/1995 | Huang |
| 5,397,252 | A | 3/1995 | Wang |
| 5,413,502 | A | 5/1995 | Wang |
| 5,430,618 | A | 7/1995 | Huang |
| 5,438,251 | A | 8/1995 | Chen |
| 5,470,257 | A | 11/1995 | Szegda |
| 5,478,258 | A | 12/1995 | Wang |
| 5,498,175 | A | 3/1996 | Yeh |
| 5,599,198 | A | 2/1997 | Wang |
| 5,600,094 | A | 2/1997 | McCabe |
| 5,613,880 | A | 3/1997 | Wang |
| 5,632,651 | A | 5/1997 | Szegda |
| 5,667,409 | A | 9/1997 | Wong |
| 5,683,263 | A | 11/1997 | Hsu |
| 5,702,261 | A | 12/1997 | Wang |
| 5,723,818 | A | 3/1998 | Yeh |
| 5,730,621 | A | 3/1998 | Wang |
| 5,803,757 | A | 9/1998 | Wang |
| 5,820,408 | A | 10/1998 | Wang |
| 5,863,226 | A | 1/1999 | Lan |
| 5,879,166 | A | 3/1999 | Wang |
| 5,924,889 | A | 7/1999 | Wang |
| 5,934,137 | A | 8/1999 | Tarpill |
| 5,951,319 | A | 9/1999 | Lin |
| 5,957,730 | A | 9/1999 | Wang |
| 5,975,949 | A | 11/1999 | Holliday |
| 5,980,308 | A | 11/1999 | Hu |
| 5,997,350 | A | 12/1999 | Burris |
| 6,024,588 | A | 2/2000 | Hsu |
| 6,065,976 | A | 5/2000 | Wang |
| 6,095,869 | A | 8/2000 | Wang |
| 6,113,431 | A | 9/2000 | Wong |
| 6,139,344 | A | 10/2000 | Wang |
| 6,146,197 | A | 11/2000 | Holliday |
| 6,153,830 | A | 11/2000 | Montena |
| 6,159,046 | A | 12/2000 | Wong |
| D436,076 | S | 1/2001 | Montena |
| 6,179,656 | B1 | 1/2001 | Wong |
| D437,826 | S | 2/2001 | Montena |
| D440,539 | S | 4/2001 | Montena |
| D440,939 | S | 4/2001 | Montena |
| 6,234,838 | B1 | 5/2001 | Wong |
| 6,276,970 | B1 | 8/2001 | Wong |
| 6,287,148 | B1 | 9/2001 | Huang |
| 6,386,912 | B1 | 5/2002 | Li |
| 6,390,840 | B1 | 5/2002 | Wang |
| D458,904 | S | 6/2002 | Montena |
| 6,402,155 | B2 | 6/2002 | Sakata |
| D460,739 | S | 7/2002 | Fox |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,478,599 | B1 | 11/2002 | Lee |
| 6,478,618 | B2 | 11/2002 | Wong |
| 6,488,317 | B1 | 12/2002 | Daoud |
| D468,696 | S | 1/2003 | Montena |
| 6,530,807 | B2 | 3/2003 | Rodrigues |
| 6,558,194 | B2 | 5/2003 | Montena |
| D475,975 | S | 6/2003 | Fox |
| D475,976 | S | 6/2003 | Montena |
| D475,977 | S | 6/2003 | Montena |
| 6,634,906 | B1 | 10/2003 | Yeh |
| 6,676,443 | B1 | 1/2004 | Wang |
| 6,716,062 | B1 | 4/2004 | Palinkas |
| 6,733,336 | B1 | 5/2004 | Montena |
| 6,767,247 | B2 | 7/2004 | Rodrigues |
| 6,767,248 | B1 | 7/2004 | Hung |
| 6,767,249 | B1 | 7/2004 | Li |
| 6,769,926 | B1 | 8/2004 | Montena |
| 6,776,650 | B2 | 8/2004 | Cheng |
| 6,776,657 | B1 | 8/2004 | Hung |
| 6,776,665 | B2 | 8/2004 | Huang |
| 6,780,052 | B2 | 8/2004 | Montena |
| 6,789,653 | B1 | 9/2004 | Hsu |
| 6,793,526 | B1 | 9/2004 | Hsu |
| 6,799,995 | B2 | 10/2004 | Hsu |
| 6,805,584 | B1 | 10/2004 | Chen |
| 6,817,897 | B2 | 11/2004 | Chee |
| 6,830,479 | B2 | 12/2004 | Holliday |
| 6,848,939 | B2 | 2/2005 | Stirling |
| 6,848,940 | B2 | 2/2005 | Montena |
| 6,860,751 | B1 | 3/2005 | Huang |
| D503,685 | S | 4/2005 | Montena |
| D504,113 | S | 4/2005 | Montena |
| D504,114 | S | 4/2005 | Montena |
| D504,402 | S | 4/2005 | Montena |
| 6,881,075 | B2 | 4/2005 | Huang |
| 6,884,113 | B1 | 4/2005 | Montena |
| D505,391 | S | 5/2005 | Rodrigues |
| 6,887,090 | B2 | 5/2005 | Lin |
| D506,446 | S | 6/2005 | Montena |
| 6,908,337 | B1 | 6/2005 | Li |
| 6,910,919 | B1 | 6/2005 | Hung |
| D507,242 | S | 7/2005 | Montena |
| 6,929,501 | B2 | 8/2005 | Huang |
| 6,929,507 | B2 | 8/2005 | Lin |
| 6,935,874 | B1 | 8/2005 | Fang |

| | | | | |
|---|---|---|---|---|
| 6,935,878 | B2 | 8/2005 | Hsu | |
| 6,948,969 | B2 | 9/2005 | Huang | |
| 6,948,973 | B1 | 9/2005 | Hsu | |
| 6,951,469 | B1 | 10/2005 | Lin | |
| 6,956,464 | B2 | 10/2005 | Wang | |
| D511,497 | S | 11/2005 | Murphy | |
| D511,498 | S | 11/2005 | Holliday | |
| D512,024 | S | 11/2005 | Murphy | |
| D512,689 | S | 12/2005 | Murphy | |
| D513,406 | S | 1/2006 | Rodrigues | |
| D513,736 | S | 1/2006 | Fox | |
| D514,071 | S | 1/2006 | Vahey | |
| D515,037 | S | 2/2006 | Fox | |
| 6,994,588 | B2 | 2/2006 | Montena | |
| 7,001,204 | B1 | 2/2006 | Lin | |
| 7,004,765 | B2 | 2/2006 | Hsu | |
| 7,004,777 | B2 | 2/2006 | Hsu | |
| 7,008,263 | B2 | 3/2006 | Holland | |
| 7,018,235 | B1 | 3/2006 | Burris | |
| D518,772 | S | 4/2006 | Fox | |
| D519,076 | S | 4/2006 | Fox | |
| D519,451 | S | 4/2006 | Fox | |
| D519,452 | S | 4/2006 | Rodrigues | |
| D519,453 | S | 4/2006 | Rodrigues | |
| D519,463 | S | 4/2006 | Tamezane | |
| 7,021,965 | B1 | 4/2006 | Montena | |
| D521,454 | S | 5/2006 | Murphy | |
| D521,930 | S | 5/2006 | Fox | |
| 7,063,551 | B1 | 6/2006 | Lin | |
| 7,118,416 | B2 | 10/2006 | Montena et al. | |
| 7,128,603 | B2 | 10/2006 | Burris | |
| D535,259 | S | 1/2007 | Rodrigues | |
| 7,182,639 | B2 | 2/2007 | Burris | |
| 7,192,308 | B2 | 3/2007 | Rodrigues | |
| D543,948 | S | 6/2007 | Montena | |
| D544,837 | S | 6/2007 | Disbennett | |
| 7,241,172 | B2 | 7/2007 | Rodrigues | |
| 7,252,546 | B1 | 8/2007 | Holland | |
| 7,255,598 | B2 | 8/2007 | Montena | |
| 7,288,002 | B2 | 10/2007 | Rodrigues | |
| 7,303,436 | B1 | 12/2007 | Li | |
| 7,354,307 | B2 * | 4/2008 | Chee et al. | 439/584 |
| 7,356,638 | B2 | 4/2008 | Holland et al. | |
| 7,364,462 | B2 | 4/2008 | Holland | |
| 7,371,113 | B2 | 5/2008 | Burris | |
| 2002/0146935 | A1 | 10/2002 | Wong | |
| 2003/0092319 | A1 | 5/2003 | Hung | |
| 2003/0194902 | A1 | 10/2003 | Huang | |
| 2003/0236027 | A1 | 12/2003 | Wang | |
| 2004/0053533 | A1 | 3/2004 | Huang | |
| 2004/0067688 | A1 | 4/2004 | Cheng | |
| 2004/0102095 | A1 | 5/2004 | Huang | |
| 2004/0147164 | A1 | 7/2004 | Li | |
| 2004/0171297 | A1 | 9/2004 | Hsu | |
| 2004/0171315 | A1 | 9/2004 | Liao | |
| 2004/0224556 | A1 | 11/2004 | Qin | |
| 2005/0009379 | A1 | 1/2005 | Huang | |
| 2005/0020121 | A1 | 1/2005 | Lin | |
| 2005/0032410 | A1 | 2/2005 | Huang | |
| 2005/0070145 | A1 | 3/2005 | Huang | |
| 2005/0075012 | A1 | 4/2005 | Hsu | |
| 2005/0153587 | A1 | 7/2005 | Hsu | |
| 2005/0159030 | A1 | 7/2005 | Hsu | |
| 2005/0186852 | A1 | 8/2005 | Hsu | |
| 2005/0186853 | A1 | 8/2005 | Hsu | |
| 2005/0202690 | A1 | 9/2005 | Lien | |
| 2005/0202699 | A1 | 9/2005 | Hsu | |
| 2005/0233632 | A1 | 10/2005 | Hsu | |
| 2005/0250357 | A1 | 11/2005 | Chen | |
| 2005/0260894 | A1 | 11/2005 | Chen | |
| 2006/0094300 | A1 | 5/2006 | Hsu | |
| 2006/0121753 | A1 | 6/2006 | Chiang | |
| 2006/0121763 | A1 | 6/2006 | Chiang | |

FOREIGN PATENT DOCUMENTS

| | | |
|---|---|---|
| WO | WO 9014697 | 11/1990 |
| WO | WO 93/05547 | 3/1993 |
| WO | WO 93/24973 | 12/1993 |
| WO | WO 96/20516 | 7/1996 |
| WO | WO 96/20518 | 7/1996 |
| WO | WO 97/22162 | 6/1997 |
| WO | WO/99/65117 | 12/1999 |
| WO | WO/99/65118 | 12/1999 |
| WO | WO03/096484 | 11/2003 |
| WO | WO/2005/083845 | 9/2005 |

* cited by examiner

SEALED COMPRESSION TYPE COAXIAL CABLE F-CONNECTORS

CROSS REFERENCE TO RELATED APPLICATION

This is a continuation-in-part application based upon a prior Utility patent application entitled Compression Type Coaxial Cable F-Connectors, Ser. No. 12/002,261, filed Dec. 17, 2007 now U.S. Pat. No. 7,513,795.

BACKGROUND OF THE INVENTION

1. Field of the Invention

The present invention relates generally to electrical connectors for coaxial cables and related electrical fittings. More particularly, the present invention relates to coaxial F-connectors of the axial compression type which are adapted to be installed with hand compression tools, and specifically to F connectors that are internally sealed when compressed. Known prior art of relevance is classified in U.S. Pat. No. Class 439, Subclasses 349, 583, and 584.

2. Description of the Related Art

A variety of coaxial cable connectors have been developed in the electronic arts for interfacing coaxial cable with various fittings. Famous older designs that are well known in the art, such as the Amphenol PL-259 plug, require soldering and the hand manipulation of certain components during installation. One advantage of the venerable PL-259 includes the adaptability for both coaxial cables of relatively small diameter, such as RG-59U or RG-58U, and large diameter coaxial cable (i.e., such as RG-8U, RG-9U, LMR-400 etc.). So-called N-connectors also require soldering, but exhibit high frequency advantages. Numerous known connectors are ideal for smaller diameter coaxial cable, such as RG-58U and RG-59U. Examples of the latter include the venerable "RCA connector", which also requires soldering, and the well known "BNC connector", famous for its "bayonet connection", that also requires soldering with some designs.

Conventional coaxial cables typically comprise a solid or stranded center conductor surrounded by a plastic, dielectric insulator and a coaxial shield of braided copper and foil. An outer layer of insulation, usually black in color, coaxially surrounds the cable. To prepare coaxial cable for connector installation, a length of the outer jacket is removed, exposing a portion of the shield that is drawn back and coaxially positioned. A portion of the insulated center is stripped so that an exposed portion the inner copper conductor can become the male prong of the assembled F-connector.

The modern F-type coaxial cable connector has surpassed all other coaxial connector types in volume. These connectors are typically used in conjunction with smaller diameter coaxial cable, particularly RG-6 cable and the like. The demand for home and business wiring of cable TV system, home satellite systems, and satellite receiving antenna installations has greatly accelerated the use of low-power F-connectors. Typical F-connectors comprise multiple pieces. Typically, a threaded, hex-head nut that screws into a suitable socket commonly installed on conventional electronic devices such as televisions, satellite receivers and accessories, satellite radios, and computer components and peripherals. The connector body mounts an inner, generally cylindrical post that extends coaxially rearwardly from the hex nut. When a prepared end of the coax is inserted, the post penetrates the cable, sandwiching itself between the insulated cable center and the outer conductive braid. A deflectable, rear locking part secures the cable within the body of the connector after compression. The locking part is known by various terms in the art, including "cap", or "bell" or "collar" or end sleeve and the like. The end cap, which may be formed of metal or a resilient plastic, is compressed over or within the connector body to complete the connection. A seal is established by one or more O-rings or grommets. Suitable grommets may comprise a silicone elastomer.

The design of typical modern F-connectors is advantageous. First, typical assembly and installation of many F-connector designs is completely solderless. As a result, installation speed increases. Further, typical F-connectors are designed to insure good electrical contact between components. The outer conductive braid for the coaxial cable, for example, is received within the F-connector, and frictional and/or compressive contact insures electrical continuity. For satellite and cable installations the desired F-connector design mechanically routes the inner, copper conductor of the coaxial cable through the connector body and coaxially out through the mouth of the connector nut to electrically function as the male portion of the connector junction without a separate part.

An important F-connector design innovation relates to the "compression-type" F-connector. Such designs typically comprise a metallic body pivoted to a hex-head nut for electrical and mechanical interconnection with a suitably threaded socket. A rigid conductive post is coaxially disposed within the connector body, and is adapted to contact the conductive outer braid of the coax when the prepared cable end is installed. After insertion of the stripped end of the coax, the rear connector cap or collar is forcibly, axially compressed relative to the connector body. A suitable hand operated compression tool designed for compression F-connectors is desirable. Some connector designs have an end cap adapted to externally mount the body, and some designs use a rear cap that internally engages the F-connector body. In some designs the cap is metal, an in others it is plastic. In any event, after the cap is compressed, the braided shield in electrically connected and mechanically secured, and a tip of the exposed copper center conductor properly extends from the connector front. The outer conductive braid is compressively forced against internal metal components to insure proper electrical connections.

One popular modern trend with compression F-connectors involves their preassembly and packaging. In some preassembled designs the rear sleeve (i.e., or end cap, collar etc.) is compressively forced part-way unto or into the connector body prior to bulk packaging. The end sleeve is pre-connected to the connector end by the manufacturer to ease the job of the installer by minimizing or avoiding installation assembly steps. For example, when the installer reaches into his or her package of connectors, he or she need draw out only one part, or connector, and need not sort connector bodies from connector end caps or sleeves and assemble them in the field, since the device end cap is already positioned by the manufacturer. Because of the latter factors, installation speed is increased, and component complexity is reduced.

Typically, preassembled compression F-connector designs involve locking "detents" that establish two substantially fixed positions for the end cap along the length of the connector body. The cap, for example, may be provided with an internal lip that surmounts one or more annular ridges or grooves defined on the connector collar for the mechanical detent. In the first detent position, for example, the end cap yieldably assumes a first semi-fixed position coupled to the lip on the connector end, where it semi-permanently remains until use and installation. The connection force is sufficient to yieldably maintain the end cap in place as the F-connectors are manipulated and jostled about. During assembly, once a prepared cable end is forced through the connector and its end cap, the connector is placed within a preconfigured void within and between the jaws of a hand-operated compression installation tool, the handles of which can be squeezed to force the connector parts together. During compression, in detented designs, the end cap will be axially forced from the first detent position to a second, compressed and "installed" detent position.

High quality F-connectors are subject to demanding standards and requirements. Modern home satellite systems distribute an extremely wide band signal, and as the demand for high definition television signals increases, and as more and more channels are added, the bandwidth requirements are becoming even more demanding. At present, F-connectors must reliably handle bandwidths approximating three GHz. As the significance of the latter factors increases, it becomes mandatory critical that the F-connector infallibly mate with the cable.

Disadvantages with prior art coaxial F-connectors are recognized. For example, moisture and humidity can interfere with electrical contact, degrading the signal pathway between the coax, the connector, and the fitting to which it is connected. For example, F-connectors use compression and friction to establish a good electrical connection between the braided shield of the coaxial cable and the connector body, as there is no soldering. Moisture infiltration, usually between the connector body and portions of the coaxial cable, can be detrimental. Signal degradation, impedance mismatching, and signal loss can increase over time with subsequent corrosion. Moisture infiltration often increases in response to mechanical imperfections resulting where coaxial compression connectors are improperly compressed.

Mechanical flaws caused by improper crimping or compression can also degrade the impedance or characteristic bandwidth of the connector, attenuating and degrading the required wide-band signal that modern TV satellite dish type receiving systems employ. If the axial compression step does not positively lock the end cap in a proper coaxial position, the end cap can shift and the integrity of the connection can suffer. Furthermore, particularly in modern, high-bandwidth, high-frequency applications involved with modern satellite applications distributing multiple high definition television channels, it is thought that radial deformation of internal coaxial parts, which is a natural consequence of radial compression F-connectors, potentially degrades performance.

Dealers and installers of satellite television equipment have created a substantial demand for stripping and installation tools for modern compression type F-connectors. However, installers typically minimize the weight and quantity of tools and connectors they carry on the job. There are a variety of differently sized and configured. F-connectors, and a variety of different compression tools for installation.

On the one hand, F-connectors share the same basic shape and dimensions, as their connecting nut must mate with a standard thread, and the internal diameter of critical parts must accommodate standard coaxial cable. On the other hand, some compression F connectors jam the end sleeve or cap into the body, and some force it externally. Some connectors use a detent system, as mentioned above, to yieldably hold the end sleeve or cap in at least a first temporary position. Still other connectors require manual assembly of the end cap to the body of the connector. In other words, size differences exist in the field between the dimensions of different F-connectors, and the tools used to install them.

The typical installer carries as few tools as practicable while on the job. He or she may possess numerous different types of connectors. Particularly with the popularity of the "detented" type of compression F-connector, hand tools customized for specific connector dimensions have arisen. The internal compression volume of the hand tool must match very specific "before" and "after" dimensions of the connector for a precision fit. After a given compression F-connector is preassembled, then penetrated by the prepared end of a segment of coaxial cable, the tool must receive and properly "capture" the connector. The most popular compression tools are known as "saddle" types, or "fully enclosed" types. In either event the tool must be sized to comfortably receive and "capture" connectors of predetermined external dimensions. Tools are designed for proper compression deflection, so the connector assumes a correct, reduced length after compression. Popular tools known in the art are available fro the Ripley Company, model 'Universal FX', the 'LCCT-1' made by International Communications, or the ICM 'VT200' made by the PPC Company.

Connector failures often result from small mechanical misalignments that result where the internal compression volume of the installation tool does not properly match the size of the captured connector. The degree of internal tool compression should closely correlate with the reduced length of the connector after axial deflection. In other words, the end sleeve or cap must be forcibly displaced a correct distance. Wear and tear over time can mismatch components. In other words, where hand tools designed for a specific connector length are used with connectors of slightly varying sizes, as would be encountered with different types or brands of connectors, improper and incomplete closure may result. Misdirected compression forces exerted upon the end cap or sleeve and the connector body or during compression can cause deformation and interfere with alignment. The asymmetric forces applied by a worn or mismatched saddle type compression tool can be particularly detrimental. Sometimes improper contact with internal grommets or O-rings results, affecting the moisture seal.

The chance that a given compression hand tool, used by a given installer, will mismatch the particular connectors in use at a given time is often increased when the connectors are of the "detent" type. Detented compression connectors, examples of which are discussed below, are designed to assume a predetermined length after both preassembly, and assembly. Thus detented F-connectors require a substantially mating compression tool of critical dimensions for proper performance. The chances that a given installer will install the requested compression F-connectors involved at a given job, or specified in a given installation contract, with the correctly sized, mating installation tool are less than perfect in reality. Another problem is that detented F-connector, even if sized correctly and matched with the correct installation tool, may not install properly unless the installer always exerts the right force by fully deflecting the tool handles. Even if a given installation tool is designed for the precise dimensions of the connectors chosen for a given job, wear and tear over the life of the hand tool can degrade its working dimensions and tolerances. Real world variables like these can conclude with an incorrectly installed connector that does not reach its intended or predetermined length after assembly.

If and when the chosen compression tool is not correctly matched to the F-connector, deformation and damage can occur during installation, particularly with detented compression F-connectors. Another problem occurs where an installer improperly positions the connector within the hand tool. Experienced installers, who may have configured and installed thousands of F-connectors over the years, often rely upon a combination of "look" and "feel" during installation when fitting connectors to the cable, and when positioning the connectors in the hand tool. Repetition and lack of attention tends to breed sloppiness and carelessness. Improper alignment and connector placement that can cause axial deformation. Sloppiness in preparing a cable end for the connector can also be detrimental.

A modern, compression type F-connector of the compression type is illustrated in U.S. Pat. No. 4,834,675 issued May 30, 1989 and entitled "Snap-n-seal Coaxial Connector." The connector has an annular compression sleeve, an annular collar which peripherally engages the jacket of a coaxial cable, an internal post coaxially disposed within the collar that engages the cable shield, and a rotatable nut at the front for connection. A displaceable rear cap is frangibly attached to the body front, and must be broken away for connector installation manually and then pre-positioned by the user on the connector end. The end cap is axially forced into coaxial engagement within the tubular compression sleeve between the jacket of the coaxial cable and the annular collar, establishing mechanical and electrical engagement between the connector body and the coaxial cable shield.

U.S. Pat. No. 5,632,651 issued May 27, 1997 and entitled "Radial compression type Coaxial Cable end Connector" shows a compression type coaxial cable end connector with an internal tubular inner post and an outer collar that cooperates in a radially spaced relationship with the inner post to define an annular chamber with a rear opening. A threaded head attaches the connector to a system component. A tubular locking cap protruding axially into the annular chamber through its rear is detented to the connector body and is displaceable axially between an open position accommodating insertion of the tubular inner post into a prepared cable end, with an annular outer portion of the cable being received in the annular chamber, and a clamped position fixing the annular cable portion within the chamber.

Similarly, U.S. Pat. No. 6,767,247 issued Jul. 27, 2004 depicts a compression F-connector of the detent type. A detachable rear cap or end sleeve temporarily snap fits or detents to a first yieldable position on the connector rear. This facilitates handling by the installer. The detachable end sleeve coaxially, penetrates the connector body when installed, and the coaxial cable shield is compressed between the internal connector post and the end sleeve.

U.S. Pat. No. 6,530,807 issued Mar. 11, 2003, and entitled "Coaxial connector having detachable Locking Sleeve," illustrates another modern compression F-connector. The connector includes a locking end cap provided in detachable, re-attachable snap engagement within the rear end of the connector body for securing the cable. The cable may be terminated to the connector by inserting the cable into the locking sleeve or the locking sleeve may be detachably removed from the connector body and the cable inserted directly into the cable body with the locking sleeve detached subsequently.

U.S. Pat. No. 5,470,257 issued Nov. 28, 1995 shows a detented, compression type coaxial cable connector. A tubular inner post is surrounded by an outer collar and linked to a hex head. The radially spaced relationship between the post and the collar defines an annular chamber into which a tubular locking cap protrudes, being detented in a first position that retains it attached to the connector. After the tubular inner post receives a prepared cable end, the shield locates within the annular chamber, and compression of the locking cap frictionally binds the parts together.

U.S. Pat. No. 6,153,830 issued Nov. 28, 2000 shows a compression F-connector with an internal post member, and a rear end cap that coaxially mounts over the cable collar or intermediate body portion. The internal, annular cavity coaxially formed between the post and the connector body is occupied by the outer conductive braid of the coaxial cable. The fastener member, in a pre-installed first configuration is movably fastened onto the connector body. The fastener member can be moved toward the nut into a second configuration in which the fastener member coacts with the connector body so that the connector sealingly grips the coaxial cable. U.S. Pat. No. 6,558,194 issued May 6, 2003 and entitled "Connector and method of operation" and U.S. Pat. No. 6,780,052 issued Aug. 24, 2004 are similar.

U.S. Pat. No. 6,848,940 issued Feb. 1, 2005 shows a compression F-connector similar to the foregoing, but the compressible end cap coaxially mounts on the outside of the body.

Another detented compression F-connector is discussed in U.S. Pat. No. 6,848,940, issued Feb. 1, 2005 and entitled "Connector and method of Operation." The connector body coaxially houses an internal post that is coupled to the inner conductor of a coaxial cable. A nut is coupled to either the connector body or the post for the connecting to a device. The post has a cavity that accepts the center conductor and insulator core of a coaxial cable. The annulus between the connector body and the post locates the coaxial cable braid. The end cap or sleeve assumes a pre-installed first configuration temporarily but movably fastened to the connector body, a position assumed prior to compression and installation. The end cap can be axially forced toward the nut into an installed or compressed configuration in which it grips the coaxial cable.

Various hand tools that can crimp or compress F-connectors are known.

For example, U.S. Pat. No. 5,647,119 issued Jul. 15, 1997 and entitled "Cable terminating Tool" discloses a hand tool for compression type F-connectors. Pistol grip handles are pivotally displaceable. A pair of cable retainers pivotally supported on a tool holder carried by one of the handles releasably retains the cable end and a preattached connector in coaxial alignment with an axially moveable plunger. The plunger axially compresses the connector in response to handle deflection. The plunger is adjustable to adapt the tool to apply compression type connector fittings produced by various connector manufactures.

Another example is U.S. Pat. No. 6,708,396 issued Mar. 23, 2004 that discloses a hand-held tool for compressively installing F-connectors on coaxial cable. An elongated body has an end stop and a plunger controlled by a lever arm which forcibly, axially advances the plunger toward and away from the end stop to radially compress a portion of the connector into firm crimping engagement with the end of the coaxial cable.

Similarly, U.S. Pat. No. 6,293,004 issued Sep. 25, 2001 entitled "Lengthwise compliant crimping Tool" includes an elongated body and a lever arm which is pivoted at one end to the body to actuate a plunger having a die portion into which a coaxial cable end can be inserted. When the lever arm is squeezed, resulting axial plunger movements force a preassembled crimping ring on each connector to radially compress each connector into sealed engagement with the cable end, the biasing member will compensate for differences in length of said connectors.

Despite numerous attempts to improve F-connectors, as evidenced in part by the large number of existing patents related to such connectors, a substantial problem with internal sealing still exists. It is important to prevent the entrance of moisture or dust and debris after the connector is installed. To avoid degradation in the direct current signal path established through the installed connector's metal parts, and the radio frequency, VHF, UHF and SHF signal paths and characteristics, a viable seal is required. Connectors are commonly used with coaxial cables of several moderately different outside diameters. For example, common RG-59 or RG-59/U coaxial cable has a different diameter than RG-6 or RG-6/U coaxial cable. Some cables have differently sized outer jackets and other internal differences that may not be readily apparent to the human eye. One way to promote sealing is through internal grommets or seals that are deflected and deformed when the fitting is compressively deployed to tightly encircle the captivated coaxial cable.

For example, U.S. Pat. No. 3,678,446 issued to Siebelist on Jul. 18, 1972 discloses an analogous coaxial connector for coaxial cables which have different sizes and structural details. An internal, coaxial sealing band is utilized for grasping the coaxial cable when the connector parts are secured together. Other examples of connectors or analogous electrical fittings with internal sealing grommets include U.S. Pat. Nos. 3,199,061, 3,375,485, 3,668,612, 3,671,926, 3,846,738, 3,879,102, 3,976,352, 3,986,737, 4,648,684, 5,342,096, 4,698,028, 6,767,248, 6,805,584, 7,118,416, and 7,364,462. Also pertinent are foreign references WO/1999065117, WO/1999065118, WO/2003096484 and WO/2005083845.

The sealing problem associated with compressive F-connectors discussed above, however, remains a difficult problem to overcome, and is the focus of this invention.

BRIEF SUMMARY OF THE INVENTION

This invention provides improved, axial compression type F-connectors designed to be quickly and reliably connected to coaxial cable of varying diameters and structures. The new F-connectors are adapted to be readily manually manipulated for accurate placement within conventional compression hand tools for subsequent compressive installation.

Each connector has a rigid, metallic hex-headed nut for threadable attachment to conventional threaded devices. An elongated, preferably molded plastic body is rotatably and axially coupled to the nut. A rigid, conductive post coaxially extends through the nut and the tubular body, captivating the nut with an internal flange. A spaced apart end of the tubular post is barbed, to penetrate and receive an end of prepared coaxial cable fitted to the F-connector. A rigid, preferably metallic end cap is slidably fitted to the body, and thereafter forcibly compressed along the length of the body shank for installation.

Preferably the tubular body has a generally cylindrical stop ring that is integral and coaxial with a reduced diameter shank. The elongated outer periphery of the body's shank is smooth and free of obstacles. No detented structure is formed upon or machined into the external shank surface. The end cap has a tubular portion that externally, coaxially mounts the body shank, and which can be axially compressed relative to the body, such that the end cap and body are telescoped relative to one another. The end cap smoothly, frictionally grips the shank of the body, and it may be positioned at any point upon the shank as desired. However, maximum displacement in response to compression is limited by the integral stop ring axially adjoining the shank.

In the best mode the connector body has a tactile means enabling an installer or handler to readily feel and detect when the connector is positioned right for subsequent installation. Preferably the annular stop ring has at least one tactile region prominently formed upon its circumference. In the best mode, there are two tactile regions, each comprising a plurality of upwardly projecting convex projections that are arranged in orderly rows and/or columns. To complement the tactile design it is preferred that the end cap be provided with a resilient ring, seated within a suitable groove that is positioned to be spaced apart from the thumb of the installer.

Preferably the open mouth of the end cap has a plurality of radial "teeth" that firmly grasp the body shank. When the end cap is slidably telescoped upon the body shank, the teeth grasp the shank for a reliable mechanical connection without radially compressing or deforming the connector body. The end cap may assume any position along the length of body shank between the annular rear end of the body and the annular stop ring face. Cable is restrained within the connector by an internal jam point that resists axial withdrawal of the cable end.

In the best mode a special sealing function is provided. To accommodate cables of different sizes and types and diameters, a generally toroidal sealing grommet is disposed within the connector end cap. Preferably there is a ring groove disposed at the end cap rear, in which the grommet seal seats. The enhanced sealing grommet, resembling an O-ring, comprises two primary portions that are integral and coaxial. The outermost portion (i.e., the outer diameter) of the preferred seal is of a generally squarish profile, adapted to flatly and snugly seat within the end cap ring groove towards the rear of the fitting. An integral, inner ring portion of the seal (i.e., abutting the inner diameter of the grommet) is somewhat rectangular, with a bulbous nose portion projecting inwardly towards the fitting front. The leading edge of the bulbous nose portion is convex. When the fitting is compressed about a prepared coax end, the shank of the fitting body contacts the bulbous nose portion and deflects and deforms the grommet to force it radially inwardly into contact with the entrained coaxial cable to provide a seal against moisture, dust, debris and the elements.

Thus a basic object is to provide an improved, compression type electrical connector suitable for satellite and cable television systems, that generates an improved seal when the fitting is installed.

Another basic object is to provide an improved compression-type F-connector that can be reliably used with a variety of different installation tools and with a variety of different cables.

It is also an object to provide a compression type F-connector of the character described that facilitates a proper "capture" by various compression installation tools.

Another object is to provide a connector of the character described that is user-friendly and easily installed. The tactile features of my preferred invention make connector handling alignment easier and faster, simplifying the job of the installer.

A related object is to provide a compression type F-connector that provides an installer with useful tactile feedback enabling him or her to speed up the installation process while maintaining quality control and connection reliability.

It is also an important object to provide a compression type F-connector of the type disclosed that reliably provides a good electrical connection path between the threaded nut, the internal post, and the coaxial cable to which the connector is fitted.

A still further object is to provide a connector suitable for use with demanding large, bandwidth systems approximating three GHz.

A related object is to provide an F-connector ideally adapted for home satellite systems distributing multiple high definition television channels.

Another important object is to provide a connector of the character described that includes an improved sealing grommet for enhancing the required weatherproof and moisture resistant characteristics of the fitting.

Another important object is to provide a compression F-connector of the character described that can be safely and properly installed without deformation of critical parts during final compression.

A related object is to provide a connector of the character described that reliably functions even when exposed to asymmetric compression forces.

Another important object is to provide an electrical connector of the character described which provides a reliable seal even when used with coaxial cables of different diameters and physical characteristics and sizes.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
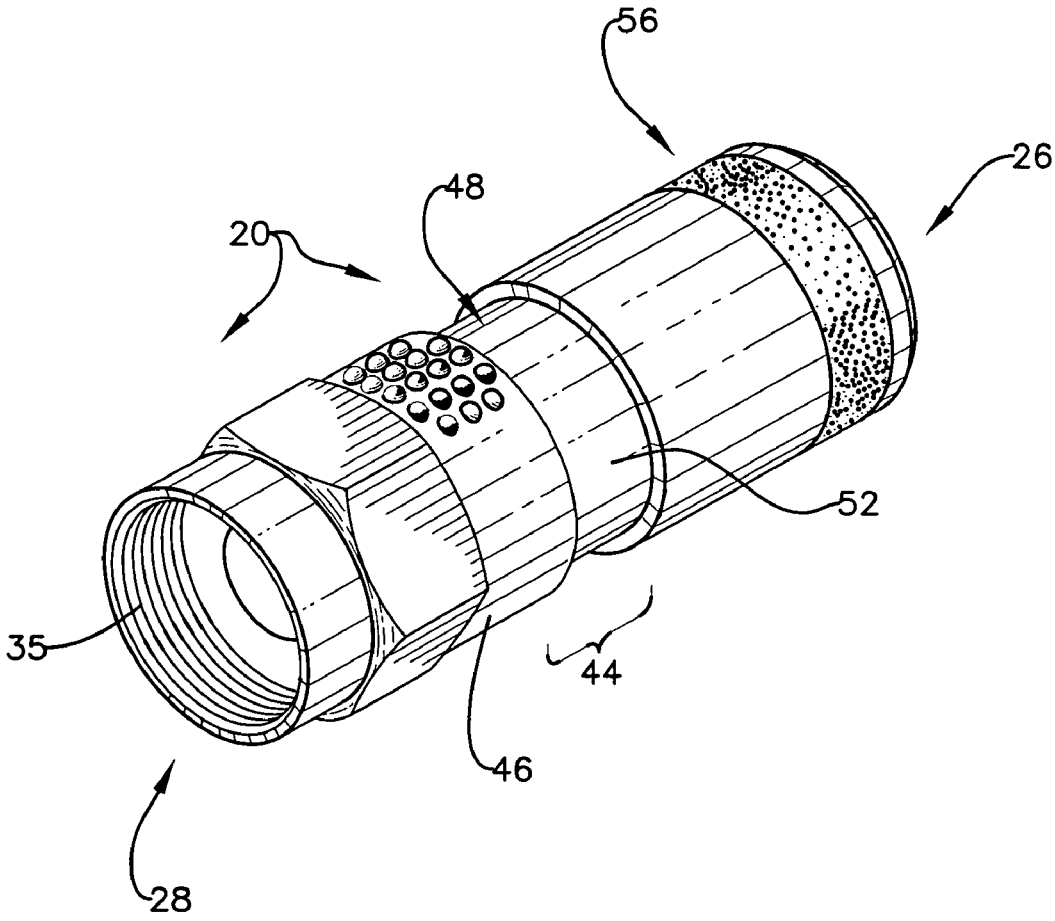
FIG. 1 is a longitudinal isometric view of the preferred connector, showing it in an uncompressed preassembly or "open" position.
Figure 4:
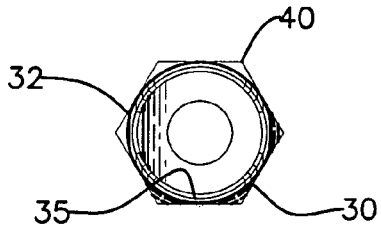
FIG. 4 is a front end view, taken from a position generally above FIG. 2 and looking down.
Figure 2:
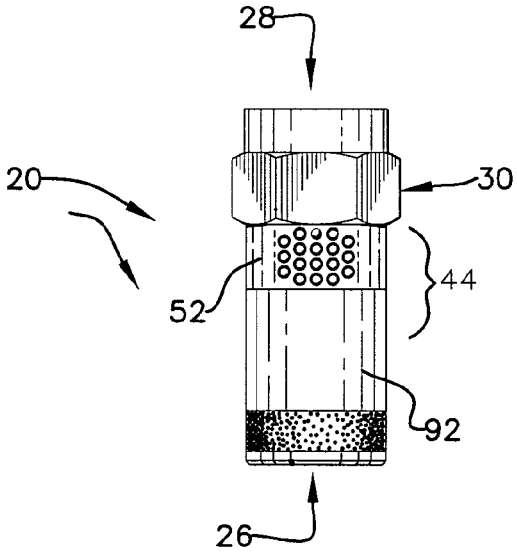
FIG. 2 is a longitudinal top plan view of the connector of FIG. 1, the bottom view substantially comprising a mirror image.

With initial reference directed to FIGS. 1-5 of the appended drawings, an open F-connector for coaxial cable constructed generally in accordance with the best mode of the invention has been generally designated by the reference numeral 20. The same connector disposed in a closed position is designated 21 (i.e., FIGS. 6-8). Connectors 20 and 21 are adapted to terminate an end of properly prepared coaxial cable, as will be discussed hereinafter. After a prepared end of coaxial cable is properly inserted through the open bottom end 26 of an open connector 20, the connector is placed within a suitable compression hand tool for compression, substantially assuming the closed configuration of FIG. 6.

Figure 11:
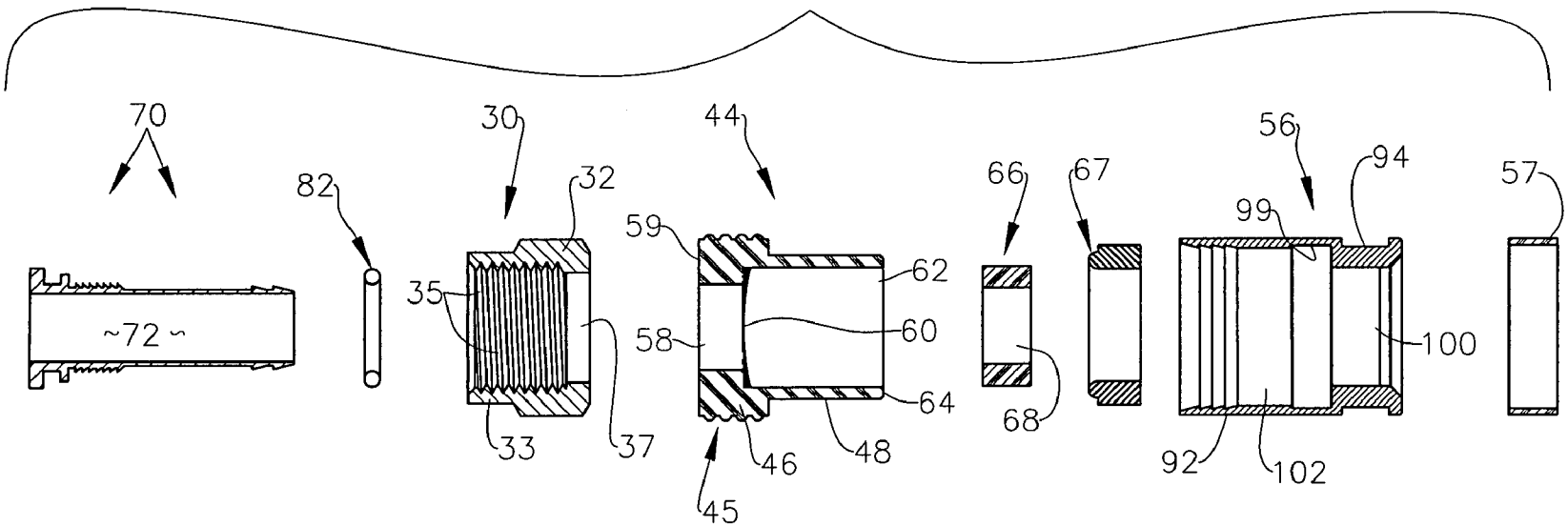
FIG. 11 is an exploded, longitudinal sectional view of the preferred connector.
Figure 13:
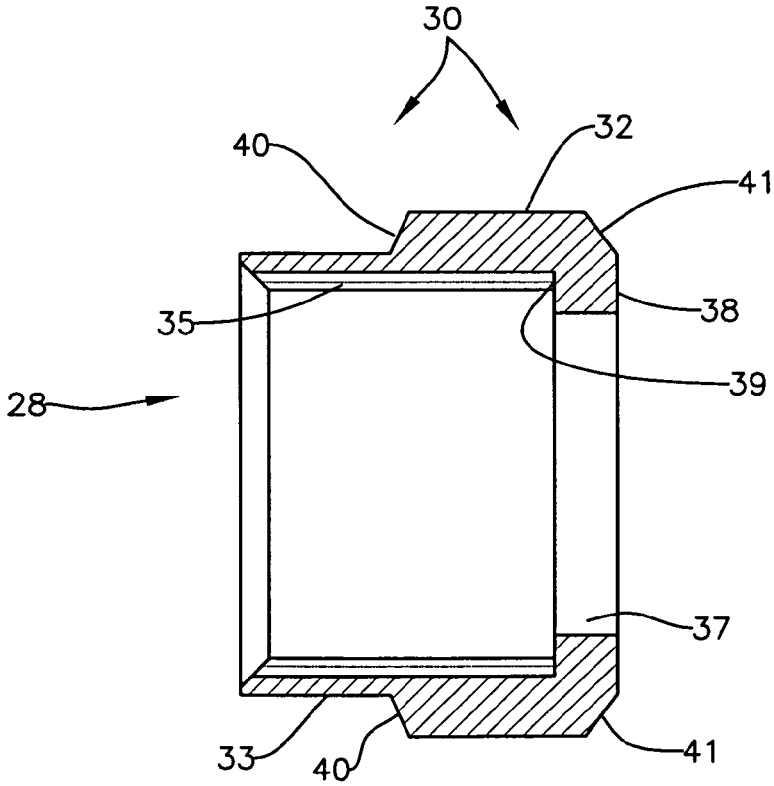
FIG. 13 is an enlarged, longitudinal sectional view of the preferred hex head.

With additional reference directed to FIGS. 11 and 13, the preferred rigid, tubular, metallic nut 30 has a conventional faceted, preferably hexagonal drive head 32 integral with a protruding, coaxial stem 33. Conventional, internal threads 35 are defined in the nut or head interior for rotatable, threadable mating attachment to a suitably-threaded socket. The open front mouth 28 of the connector (i.e., FIGS. 1, 13) appears at the front of stem 33 surrounded by annular front face 34 (FIG. 13). A circular passageway 37 is concentrically defined in the faceted drive head 32 at the rear of nut 30. Passageway 37 is externally, coaxially bounded by the outer, round peripheral wall 38 forming a flat, circular end of the connector nut 30. An inner, annular shoulder 39 on the inside of head 32 is spaced apart from and parallel with outer wall 38 (FIG. 13). A leading chamfer 40 and a spaced part rear chamfer 41 defined on hex head 32 are preferred for ease of handling.

An elongated, tubular body 44 preferably molded from plastic is rotatably coupled to the nut 30. Body 44 preferably comprises a tubular stop ring 46 (i.e., FIG. 11) that is integral with a reduced diameter shank 48 sized to fit as illustrated in FIG. 11. The elongated, outer periphery 52 (FIG. 14) of shank 48 is smooth and cylindrical. The larger diameter stop ring 46 has an annular, rear wall 54 (FIG. 14) that is coaxial with shank 48. An end cap 56 is pressed unto body 44, coaxially engaging the shank 48. The end cap 56 discussed hereinafter (i.e., FIGS. 11, 15) will smoothly, frictionally grip body 44 along and upon any point upon body shank 48, with maximum travel or displacement limited by stop ring 46. In other words, when the end cap 56 is compressed unto the body of either connector 20, 21, and the connector 20, 21 assumes a closed position (i.e., FIG. 6), annular wall 54 on the body stop ring 46 will limit maximum deflection or travel of the end cap 56.

The resilient, preferably molded plastic body 44 is hollow. Stop ring 46 has an internal, coaxial passageway 58 extending from the annular front face 59 defined at the body front (i.e., FIG. 14) a major portion of the ring length. Passageway 58 extends to an inner, annular wall 60 that coaxially borders another passageway 62, which has a larger diameter than passageway 58. The elongated passageway 62 is coaxially defined inside shank 48 and extends to rear, annular surface 64 (FIG. 14) coaxially located at the rear end of the shank 48.

For moisture sealing, it is preferred that first and second generally annular sealing grommets 66 and 67 be employed (FIG. 11). Grommet 66 is inserted within body 44 through passageway 62, coming to rest against inner, annular wall 60 (i.e., FIG. 14). The enhanced sealing grommet 67 is coaxially disposed within end cap 56 as explained in detail hereinafter.

Grommet 66 is preferably made of a silicone elastomer. The diameter of body shank passageway 62 (FIGS. 11, 14) is substantially the same as the outer diameter of grommet 66. However, the diameter of inner grommet passageway 68 (FIG. 11) is preferably less than the diameter of body passageway 58 (FIGS. 11, 14) to dependably, frictionally engage the post 70 described below that in assembly coaxially penetrate head 30 and body 44.

Figure 7:
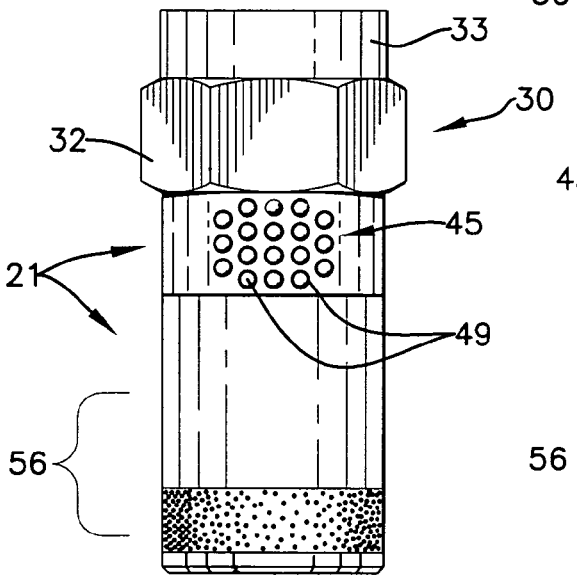
FIG. 7 is a longitudinal top plan view of the closed connector of FIG. 6, the bottom view substantially comprising a mirror image.
Figure 8:
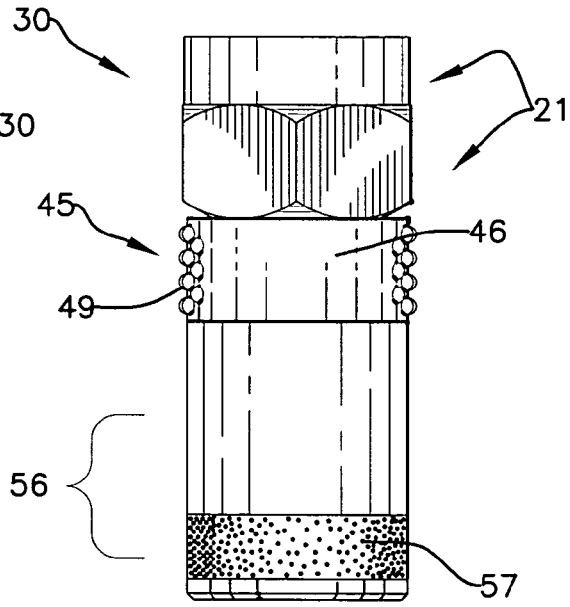
FIG. 8 is a longitudinal side elevational view of the closed connector of FIGS. 6 and 7, the opposite side view substantially comprising a mirror image.
Figure 9:
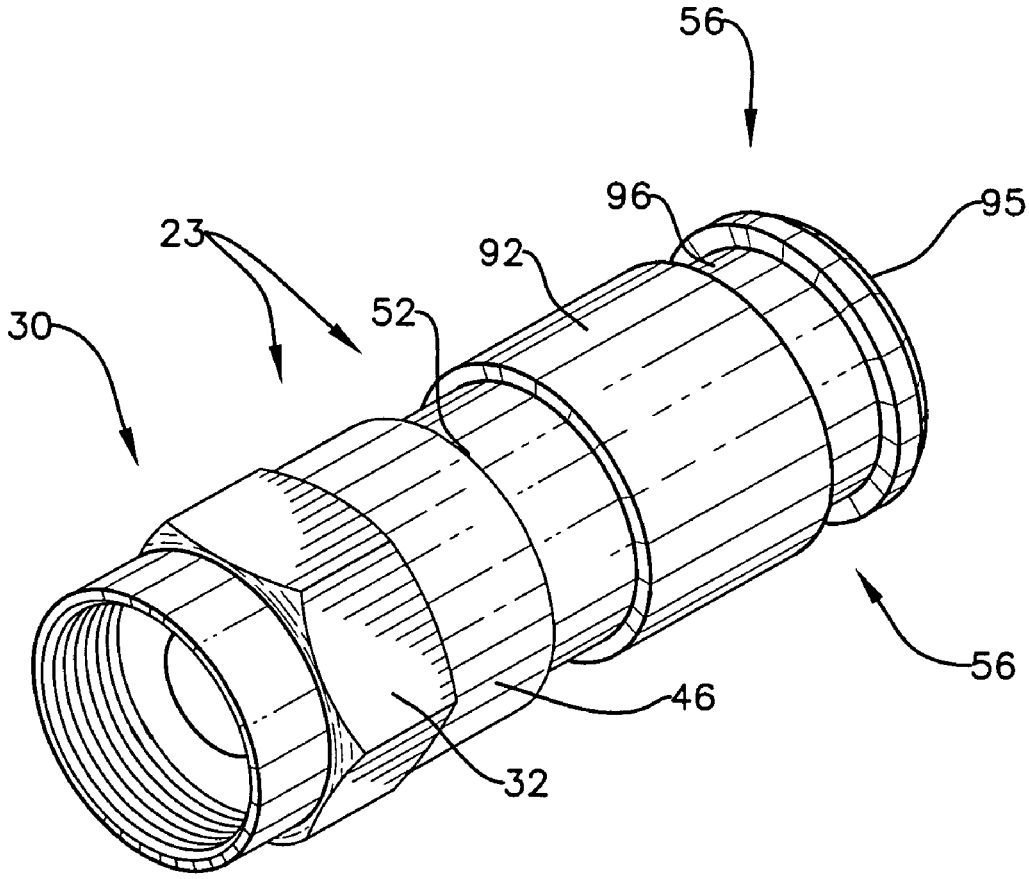
FIG. 9 is a longitudinal isometric view of an alternative preferred connector, showing it in an uncompressed preassembly or "open" position.
Figure 10:
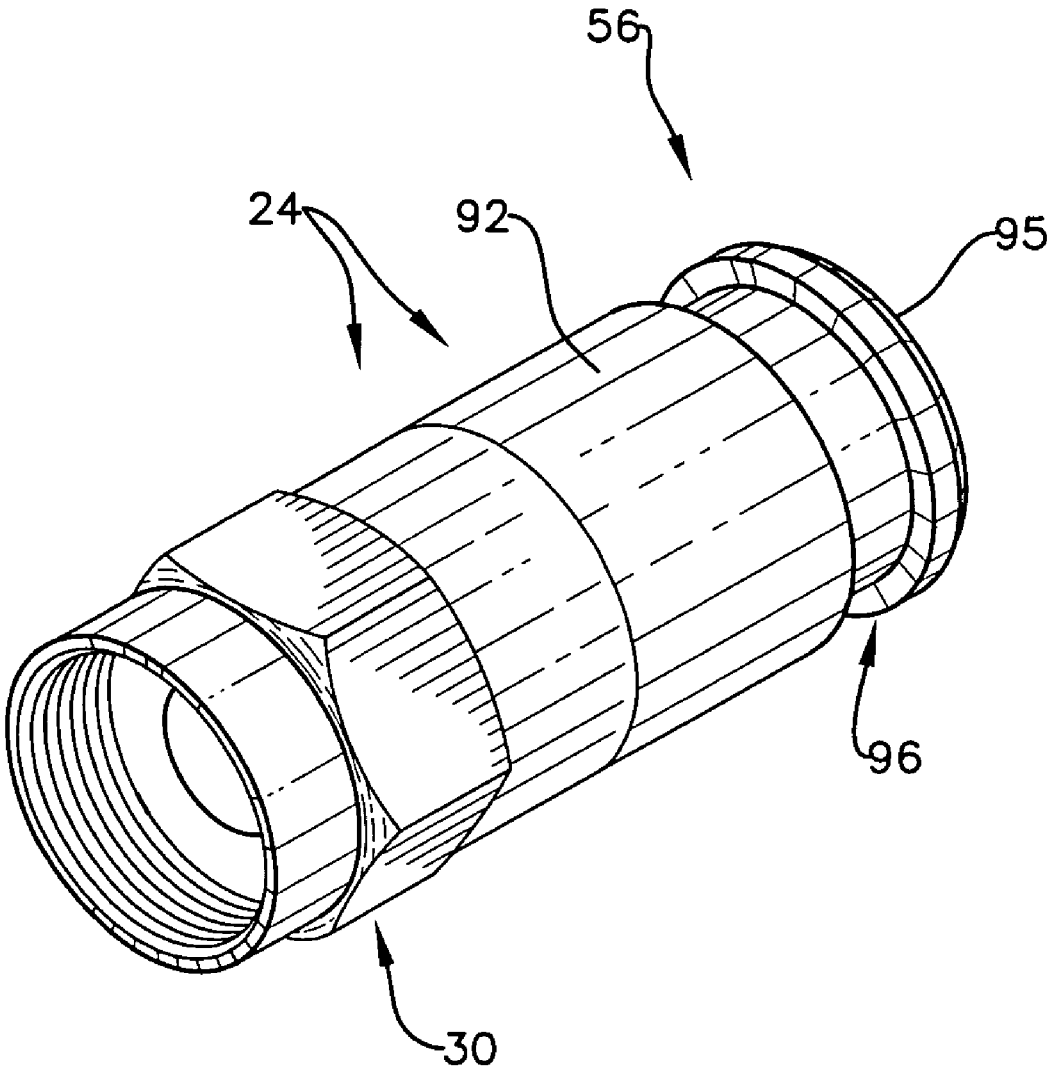
FIG. 10 is a longitudinal isometric view of the alternative connector of FIG. 9, showing it in a compressed or "closed" position.

Importantly, body 44 has a tactile means that is easily identified and recognized by an installer through the sense of touch when he or she grasps a connector with his hand. The ring-shaped stop ring 46 defined on body 44 has at least one tactile region 45 prominently defined upon its external periphery to be appreciated by the sense of touch. As best seen in FIGS. 8 and 11, there are preferably two tactile regions 45, one on top and one on the bottom of the connector 20, 21. Each tactile region 45 preferably (i.e., FIGS. 1, 7, 11 and 14), comprises a plurality of regularly spaced apart, convex projections 49 rising upwardly away from the outer, cylindrical surface of the body's integral stop ring 46. The connectors 23, 24 in FIGS. 9 and 10 comprise an annular stop ring 46 as before, but there is no specific tactile surface defined upon it. Preferably these tactile projections 49 are arranged in orderly rows and/or columns.

The tactile projections provide a definite "feel" when touched or grasped by an installer, who may grasp the connector between the thumb and forefinger, pressing against opposite tactile regions. The resultant tactile "feel" makes it easier to repetitively handle and position connectors on the job. The resultant tactile feedback allows the installer to conveniently manipulate and position the connector 20, 21 while forcing a prepared coax end through it, and to thereafter properly align the connector within the gripping mechanism of an installing tool conveniently and quickly. Proper connections can be made without tediously and continuously focusing ones eyes on the connector and coax. As explained later, a resilient ring 57 preferably attached to the end cap 56 enhances the overall tactile feel of the connectors 20, 21.

Figure 12:
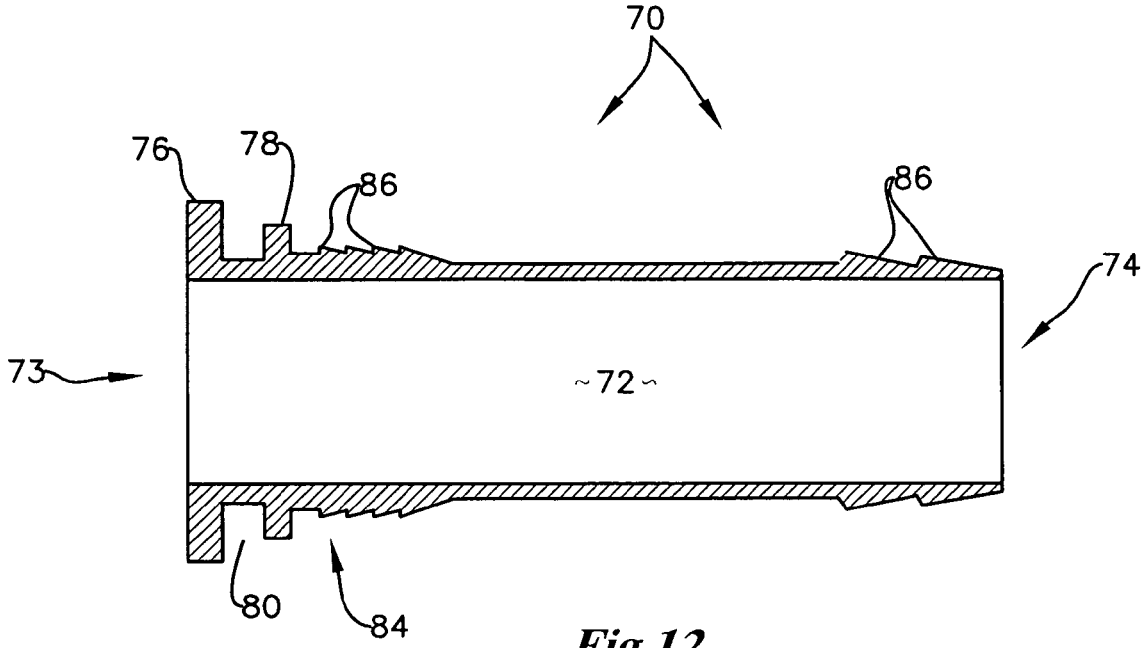
FIG. 12 is an enlarged, longitudinal sectional view of the preferred post.
Figure 14:
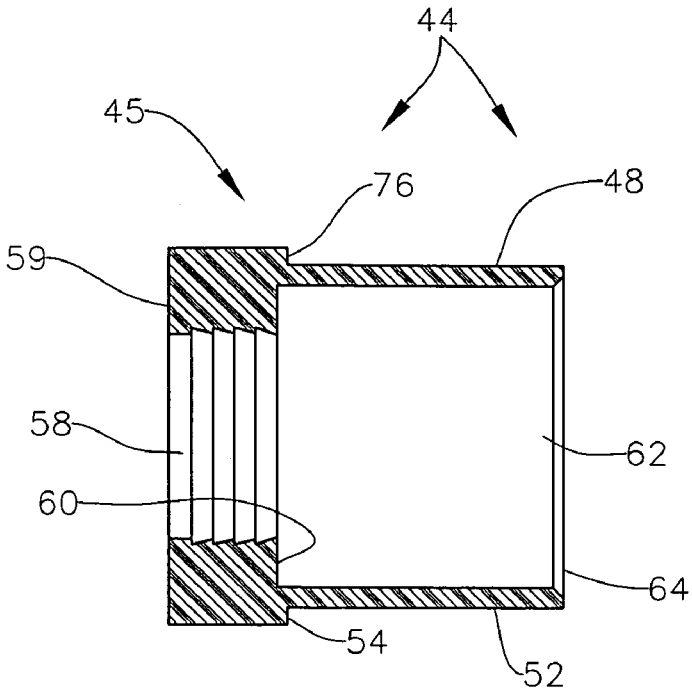
FIG. 14 is an enlarged, longitudinal sectional view of the preferred connector body.
Figure 17:
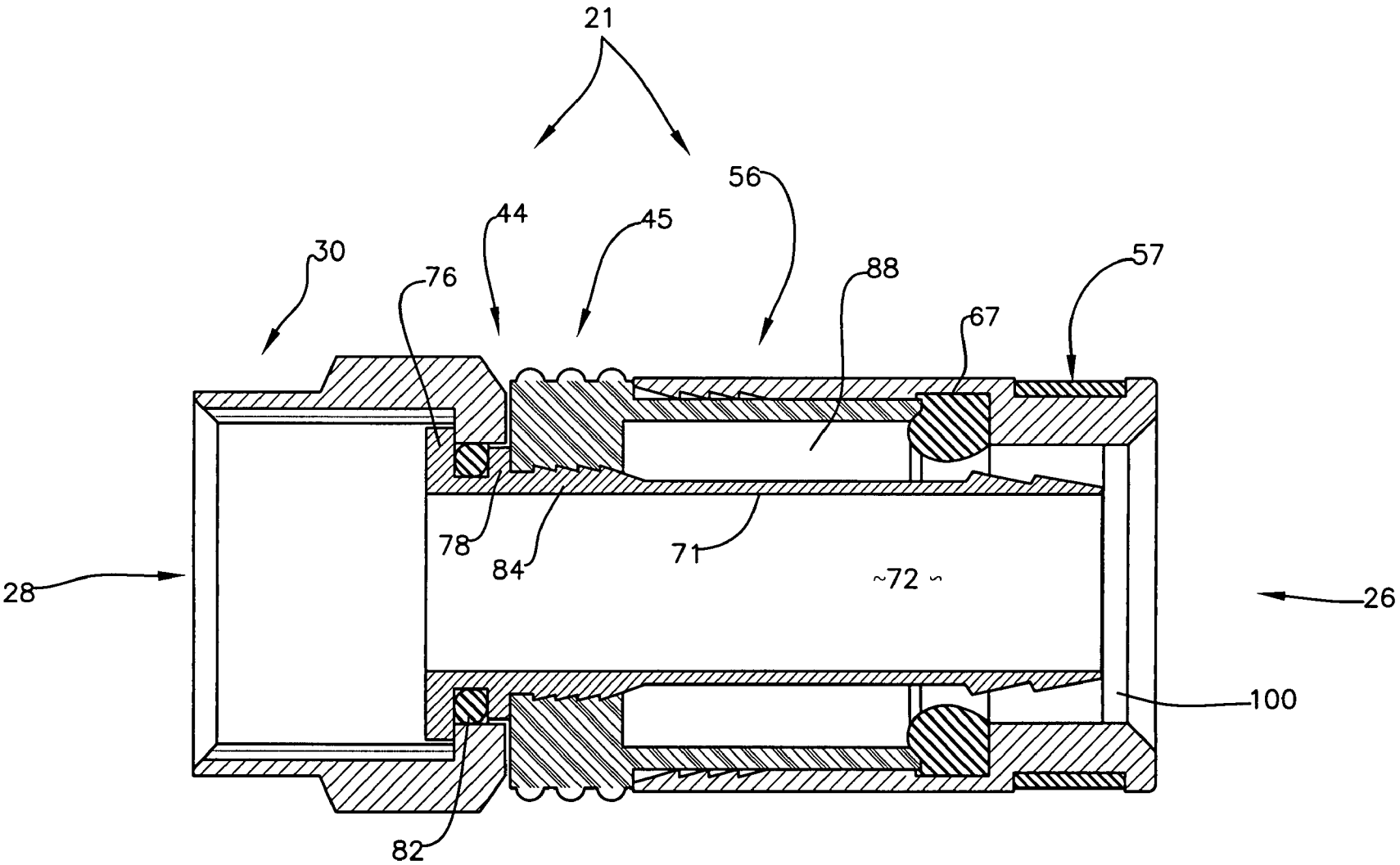
FIG. 17 is a longitudinal sectional view similar to FIG. 16, showing the connector in the "closed" or compressed position, with no coaxial cable inserted.

With primary reference directed now to FIGS. 11 and 12, the post 70 rotatably, mechanically couples the hex headed nut 30 to the plastic body 44. The metallic post 70 also establishes electrical contact between the braid of the coax (i.e., FIGS. 18, 19) and the nut 30. The tubular post 70 defines an elongated shank 71 with a coaxial, internal passageway 72 extending between its front 73 and rear 74 (FIG. 12). A front, annular flange 76 is spaced apart from an integral, reduced diameter flange 78, across a ring groove 80. A conventional, resilient O-ring 82 (FIG. 11) is preferably seated within ring groove 80 when the connector is assembled. A barbed collar region 84 having multiple, external barbs 86 is press fitted into the body 44, frictionally seating within passageway 58 (i.e., FIG. 11) and coaxially penetrating grommet 66. In assembly it is also noted that post flange 76 (i.e., FIG. 12) axially contacts inner head wall 39 (FIG. 13). Inner post flange 78 axially abuts front face 59 (FIG. 14) of body 44 with post 70 penetrating passageway 58. The sealing O-ring 82 is circumferentially frictionally constrained within nut 30 coaxially inside passageway 37 (FIGS. 11, 17). Finally, the rear end 74 of post shank 71 has a pair of spaced-apart rings forming barbs 86 (FIG. 12) that penetrate the coaxial cable, such that the inner insulated coaxial cable conductor penetrates passageway 72 and enters the front mouth 28 formed by the nut 30. Also, the braided shield of the coax is positioned around the exterior of post shank 71, within annulus 88 (FIG. 17) coaxially formed within passageway 62 between post 70 and the shank 48 of body 44 (FIGS. 11, 14).

Figure 3:
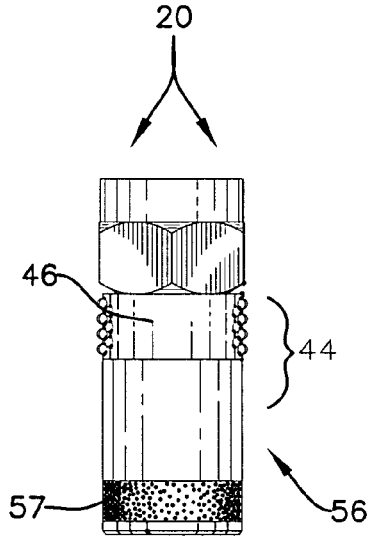
FIG. 3 is a longitudinal side elevational view of the connector of FIGS. 1 and 2, the opposite side view substantially comprising a mirror image.
Figure 5:
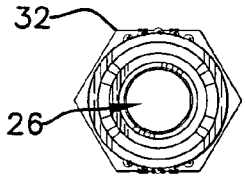
FIG. 5 is a rear end view, taken from a position generally below FIG. 2 and looking up.
Figure 6:
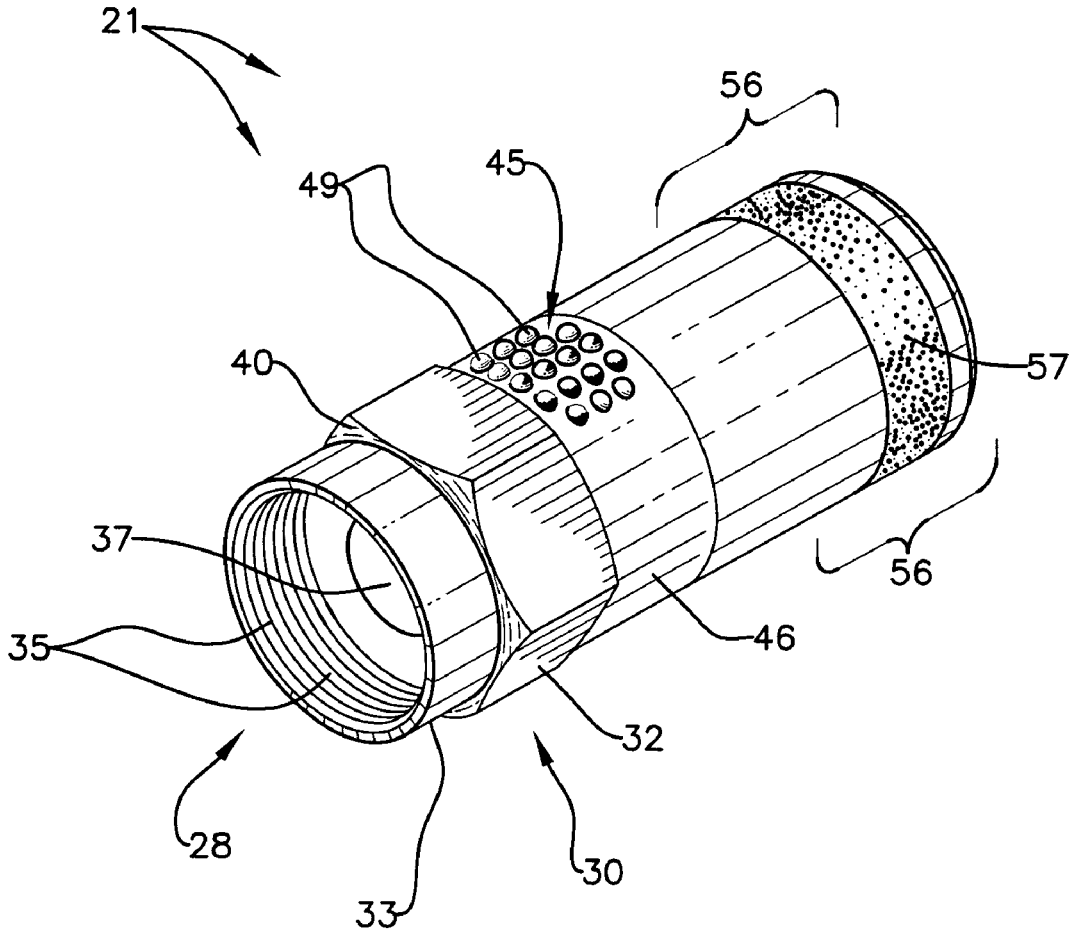
FIG. 6 is a longitudinal isometric view of the preferred connector similar to FIG. 1, but showing it in a compressed, "closed" position assumed after compression.
Figure 15:
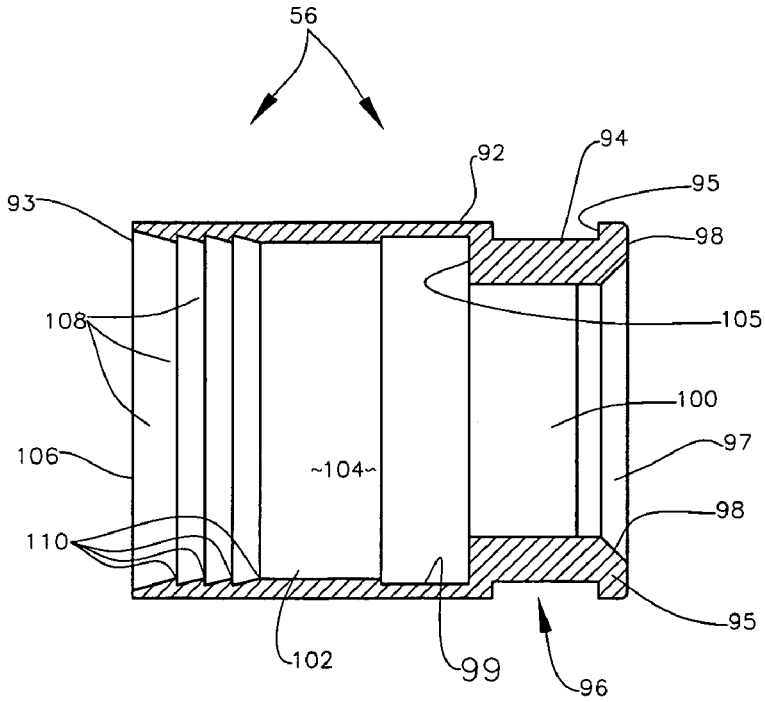
FIG. 15 is an enlarged, longitudinal sectional view of the preferred end cap.

The preferred end cap 56 is best illustrated in FIGS. 11 and 15. The rigid, preferably metallic end cap 56 comprises a tubular body 92 that is integral and concentric with a rear neck 94 of reduced diameter. The neck 94 terminates in an outer, annular flange 95 forming the end cap rear and defining a coaxial cable input hole 97 with a beveled peripheral edge 98. In all embodiments 20, 21 (FIGS. 2, 6) and 23, 24 (FIGS. 9, 10), an external, annular ring groove 96 is concentrically defined about neck 94 (FIG. 15). The ring groove 96 is axially located between body 92 and flange 95. The front of the end cap 56, and the front of body 92 (FIG. 15) is defined by concentric, annular face 93. The external ring groove 96 is readily perceptible by touch. However, it is preferred that resilient ring 57 (FIG. 11) be seated within groove 96 in embodiments 20, 21 as seen in FIGS. 3 and 6. Internal ring groove 99 (FIG. 15) seats the second sealing grommet 67 (FIG. 11).

Hole 97 at the rear of end cap 56 (FIG. 15) communicates with cylindrical passageway 100 concentrically located within neck 94. Passageway 100 leads to a larger diameter passageway 102 defined within end cap body 92. Ring groove 99 is disposed between passageways 100 and 102. Passageway 102 is sized to frictionally, coaxially fit over shank 48 of connector body 44 in assembly. There is an inner, annular wall 105 concentrically defined about neck 94 and facing within large passageway 102 within body 92 that is a boundary between end cap body 92 and end cap neck 94. Grommet 67 (i.e., FIGS. 11, 21) bears against wall 105 in operation. Once a prepared end of coaxial cable is pushed through passageways 100, and 102 it will expanded in diameter as it is axially penetrated by post 70, and subsequent withdrawal from the connector will be resisted by contact with the deformed grommet 67 (i.e. FIG. 22) whose axial travel is resisted by internal wall 105 (FIG. 15).

The smooth, concentric outer surface of the connector body's shank 48 (i.e., FIG. 11) fits snugly within end cap passageway 102 when the end cap 56 is telescopingly, slidably fitted to the connector body 44. Cap 56 may be firmly pushed unto the connector body 44 and then axially forced a minimal, selectable distance to semi-permanently retain the end cap 56 in place on the body (i.e., coaxially frictionally attached to shank 48). There is no critical detented position that must be assumed by the end cap. The inner smooth cylindrical surface 104 of the end cap 56 is defined concentrically within body 92 (FIG. 15). Surface 104 coaxially, slidably mates with the smooth, external cylindrical surface 52 (FIG. 14) of the body shank 48. Thus the end cap 56 may be partially, telescopingly attached to the body 44, and once coax is inserted as explained below, end cap 56 may be compressed unto the body, over shank 48, until the coax end is firmly grasped and the parts are locked together. It is preferred however that the open mouth 106 at the end cap front have a plurality of concentric, spaced apart beveled rings 108 providing the end cap interior surface 104 with peripheral edges or "teeth" 110 that firmly grasp the body shank 48 (i.e., FIGS. 11, 14). Preferably there are three such "teeth" 110.

When the end cap 56 is compressively mated to the body 44, teeth 110 can firmly grasp the plastic shank 48 and make a firm connection without radially compressing the connector body, which is not deformed in assembly. The end cap may be compressed to virtually any position along the length of body shank 48 between a position just clearing annular surface 64 (i.e., FIG. 14) and the annular face 54 at the rear of the body stop ring 46 (FIG. 14). Maximum deflection of the end cap is limited when the front face 93 of the end cap (FIG. 15) forcibly contacts the annular rear wall 54 (FIG. 14) of the connector body 44. At this time the surface 64 of body shank 48 will compressively engage and deform the grommet 67, as in FIG. 17, sealing the coaxial cable coaxially captivated within the compressed connector.

Figure 16:
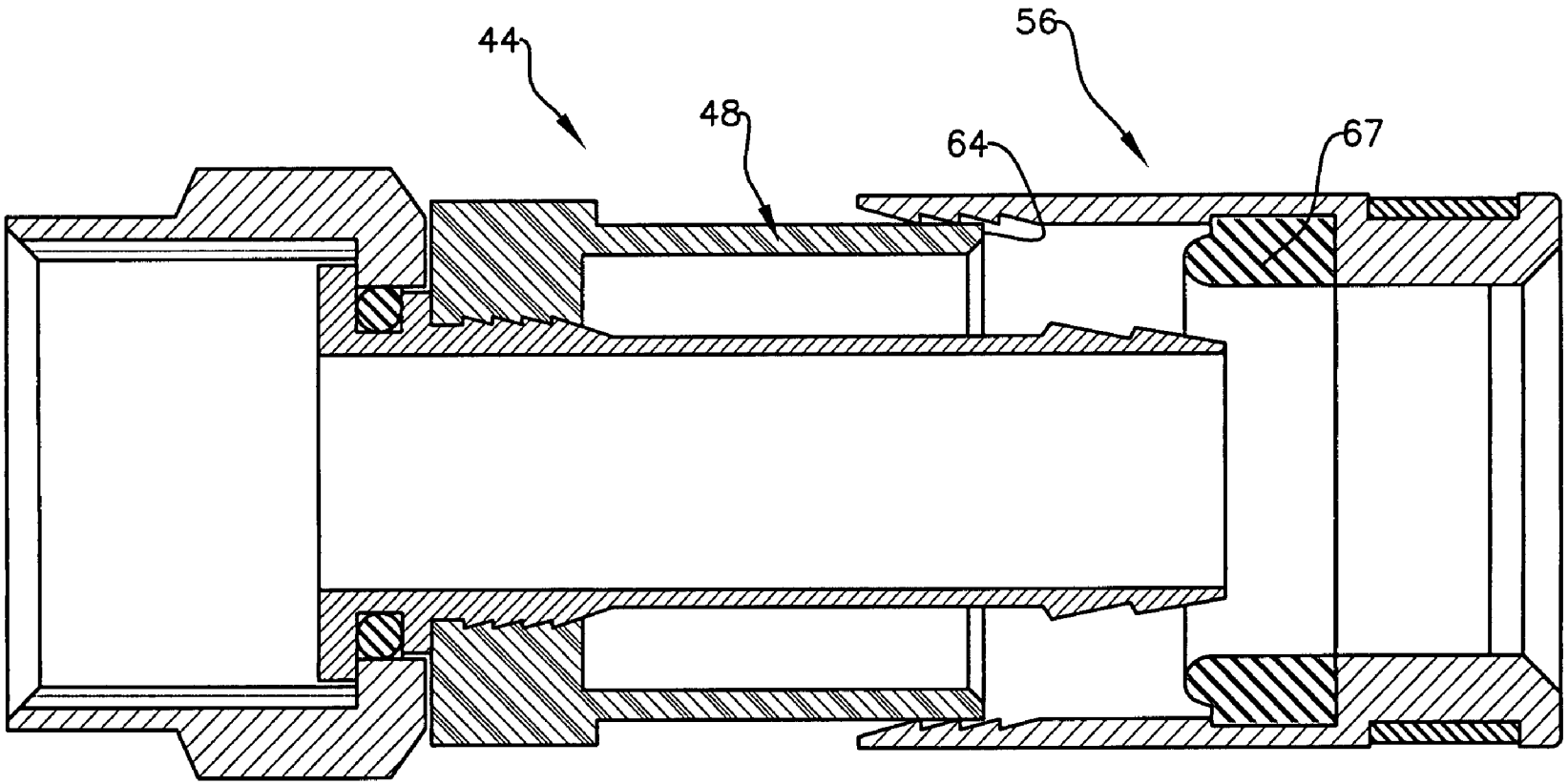
FIG. 16 is an enlarged, longitudinal sectional view of the preferred connector, shown in an uncompressed position, with no coaxial cable inserted.

In FIG. 16 it can be seen that when the end cap 56 is first coupled to the shank 48 of body 44, the shank 64 is axially spaced apart from the grommet 67. However, when the fitting is compressed during installation, the shank end 64 is forced into and against the grommet 67, which deforms as in FIG. 17. The mass of the grommet 67 is radially and concentrically directed towards the coaxial cable to seal it.

Figure 18:
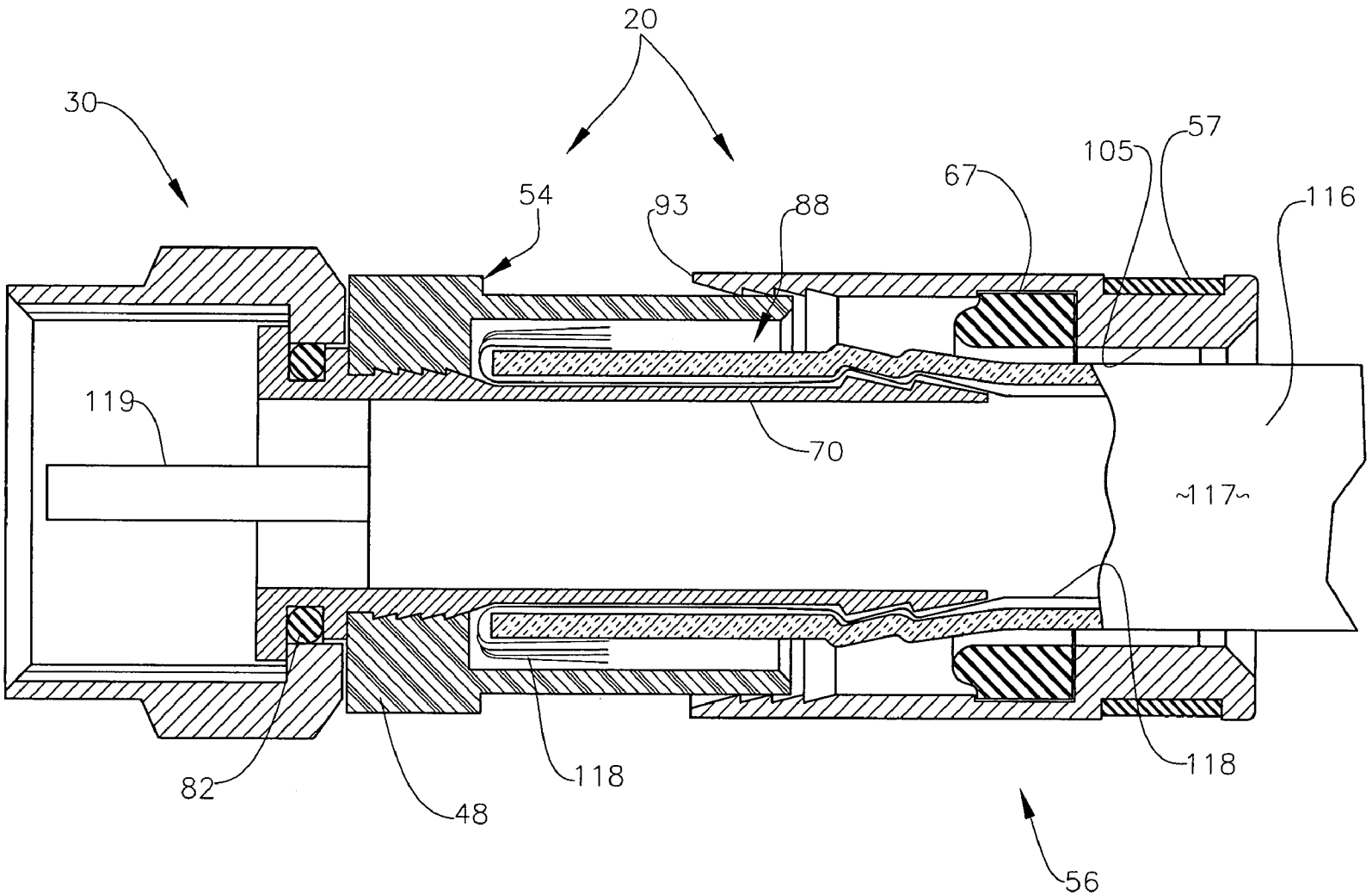
FIG. 18 is a view similar to FIG. 16, showing the connector in an open position, with a prepared end of coaxial cable inserted.
Figure 19:
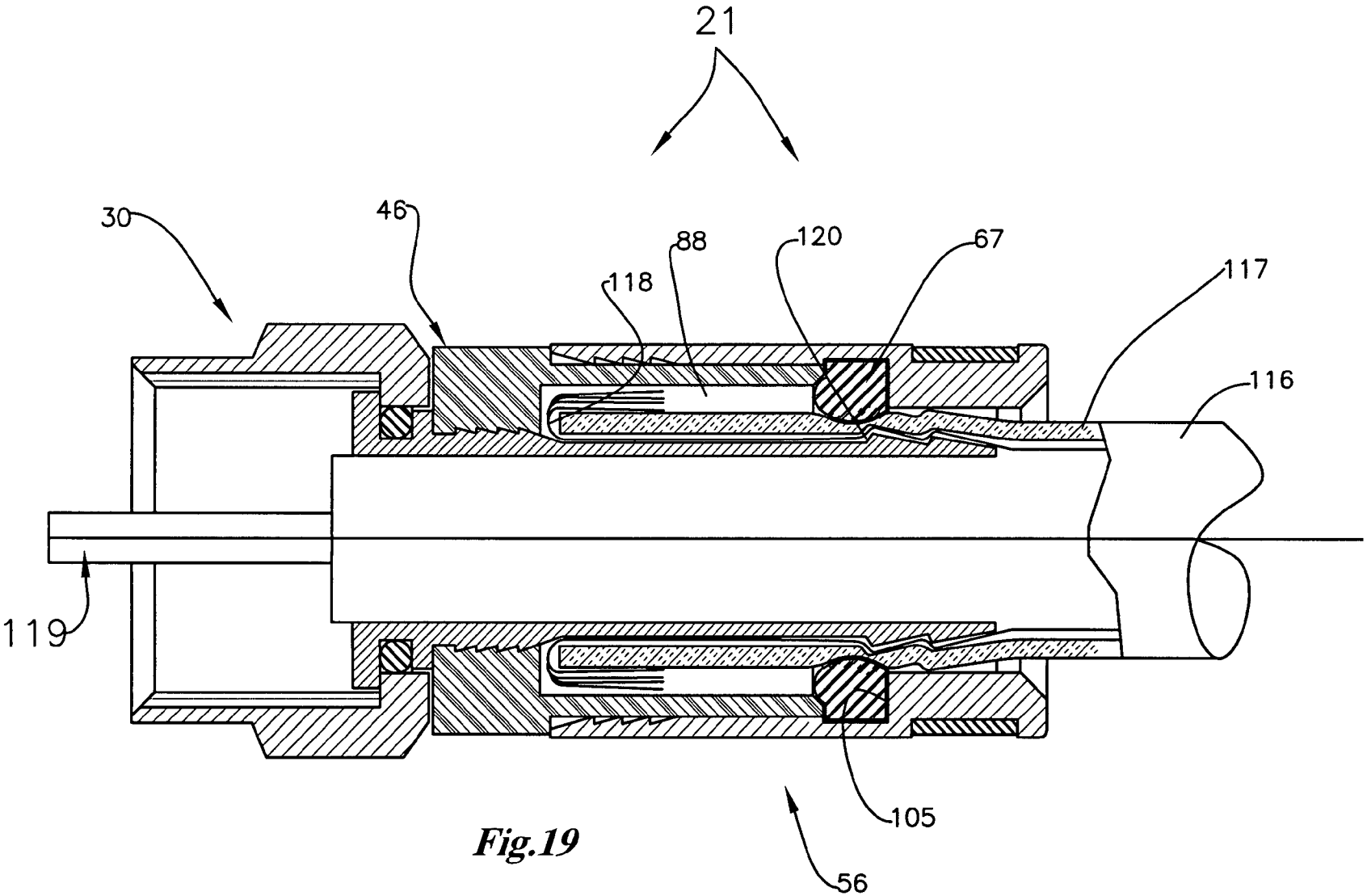
FIG. 19 is a view similar to FIG. 17, showing the connector in a closed position, with a prepared end of coaxial cable inserted.

In FIGS. 18 and 19 a prepared end of coaxial cable 116 is illustrated within the connector. The coaxial cable 116 has an outermost plastic covering 117, a concentric braided metal sheath 118, and an inner conductor 119. When the prepared end is first forced through the connector rear, passing through end connector hole 97 (FIG. 15) and through passageways 100, 102, the end cap 56 is uncompressed as in FIG. 18. The coaxial cable prepared end is forced through the annulus 88 between the post 70 and the inner cylindrical surface of shank 48 (FIG. 14) with post 70 coaxially penetrating the coax between the conductive braid 118 and the insulated inner conductor. The outer metallic braid is folded back, and as seen in FIGS. 18 and 19, makes electrical contact with the post 70 and portions of the end cap 56. The innermost cable conductor is routed through the post, and protrudes from the mouth 28 (i.e., FIG. 16) of the nut 30, where conductor 119 forms the male portion of the F-connector 20, 21. Axial withdrawal of the coax after compression of the end cap 56 (FIG. 18) is prevented by the deformed grommet 67 and the inner wall 105 (FIG. 18), within the end cap near the jam point 120 (FIG. 19).

Figure 20:
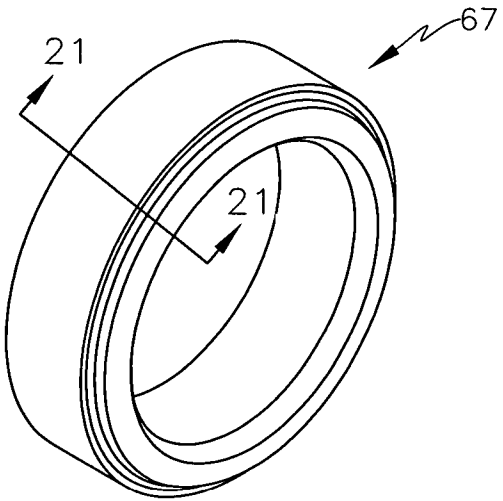
FIG. 20 is an enlarged isometric view of the preferred sealing grommet.
Figure 21:
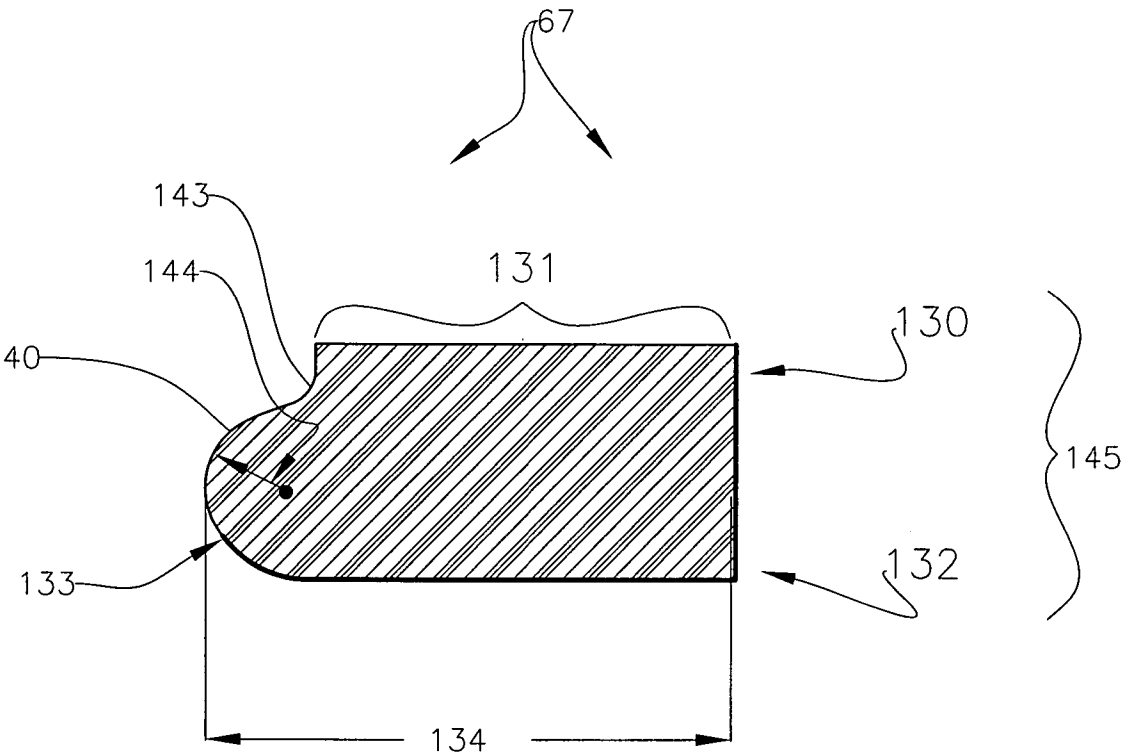
FIG. 21 is an enlarged sectional view of the uncompressed grommet taken generally along lines 21-21 of FIG. 20; and, FIG. 22 is an enlarged sectional view of the sealing grommet similar to FIG. 21, but showing the distorted shape of the grommet resulting from fitting compression.
Figure 22:
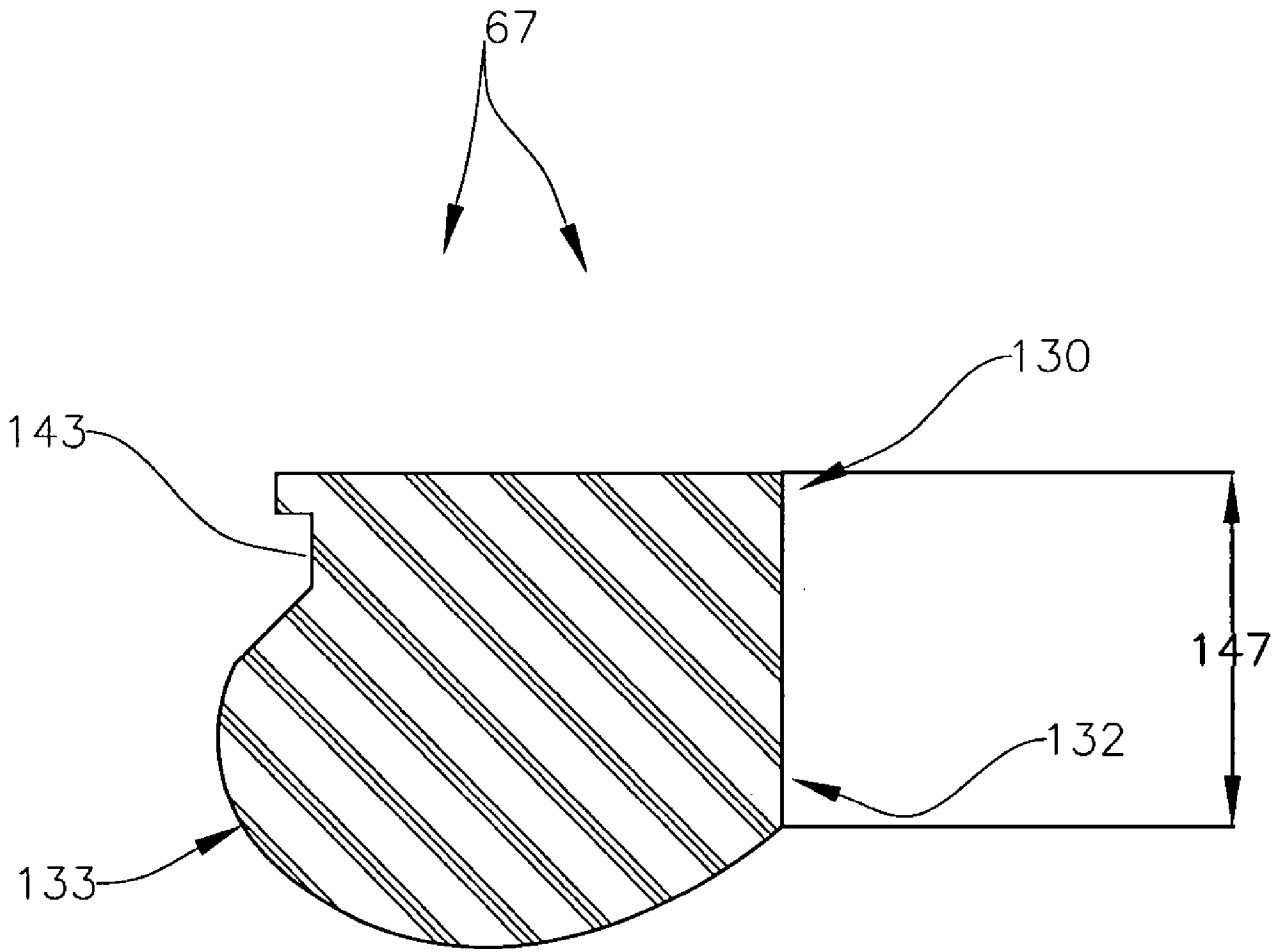

Referring now to FIGS. 20-22, enhanced sealing grommet 67 is generally toroidal. In cross section it is seen that grommet 67 comprises two primary portions that are integral and coaxial. The outermost portion 130 (i.e., the outer diameter) of grommet 67 is of a generally squarish profile, enabling the grommet 67 to snugly seat within the end cap ring groove 99 discussed earlier. The grommet length along outer portion 130 is designated by the reference numeral 131, and in the best mode this distance is 3.6 mm. An integral, inner bulbous grommet portion 132 has a length 134 (i.e., preferably 4 mm.) that is larger than the outer length 131. Thus, at and along its inner diameter region, grommet 67 is greater in length than at its outer diameter region along width 131 (FIG. 20). The ratio between the length of the uncompressed grommet 67 at its outer diameter region 131 (FIG. 21) and the length of the grommet at its inner diameter region 134 is preferably 0.9, or 90%.

Preferably, bulbous grommet region 132 comprises a convex nose 133 that, in assembly, points into the interior of the connector towards the head 30. A slightly inclined neck 143 (FIG. 20) transitions from the curved, outer edge 140 of the bulbous region to the outer diameter, reduced length region 131 of the grommet that preferably seats within ring groove 99. The arcuate leading edge 140 of nose 133 has a radius 144, substantially establishing a semicircular geometry. Radius 144 is preferably 20% or the length of grommet length 131 at its outer diameter portion (FIG. 21).

When the connector is compressed, shank 48 of body 44 and end cap 56 are forced together. The enhanced sealing grommet 67 is squeezed therebetween. Specifically, region 64 (FIG. 16) of shank 48 forcibly, contacts grommet 67 at neck 143, and deforms and squeezes the grommet 67. When squeezed during installation compression, the grommet 67 deforms as in FIG. 22. The normal uncompressed thickness of the uncompressed grommet, comprising the distance 145 (FIG. 21) between the outer diameter of the grommet and the inner diameter of the grommet, is distorted into the larger thickness 147 seen in FIG. 21 that is larger than thickness 145 (FIG. 21). Grommet 67 is axially constrained at this time by rear annular wall 105 in the end cap. As seen, for example, in FIG. 19, grommet deformation pressures the coax all around its periphery, and forms a seal.

Thus, the preferred special sealing grommet 67 disposed in the end cap of the fitting is uniquely shaped with a rounded bulbous convex "nose". This unique protrusion tends to grasp the outer PVC jacket and aids in locking the coax jacket in position if unusual forces are applied to the coax. For example, if the coaxial cable is accidentally pulled outwardly, (i.e., an axial pull), the bulbous nose 133 presses radially inwardly on the PVC jacket of the coax, causing extra locking pressure to be exerted and further resisting the accidental extraction of the coax. The bulbous nose functions as a special locking device which reacts only when axial pressure is applied to the coax which might render the electrical connection useless if the coax were to be released outwardly any distance whatsoever from the electrical mating connection.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A compressible F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow post having a flanged end mechanically coupled to said nut and a reduced diameter trailing end adapted to be inserted into said prepared cable end around the center conductor insulation and coaxially beneath said outer conductive braid;

a hollow tubular body coaxially disposed over said post, the body having a front end disposed adjacent said nut, said body comprising an integral, elongated tubular shank and an internal passageway with a diameter greater than the diameter of said post such that an annular void is formed between said post and said body;

a tubular end cap comprising an open end and a terminal end, the end cap comprising a smooth hollow interior, and the end cap adapted to be slidably coupled to said body shank, the end cap comprising an interior passageway through which coaxial cable may pass, and an internal ring groove adjacent the terminal end, the hollow interior of the tubular end cap comprising teeth means for frictionally gripping said body shank;

an enhanced, generally toroidal sealing grommet disposed within said internal ring groove within said end cap, the enhanced sealing grommet comprising innermost and outermost portions that are integral and coaxial, the outermost portion forming the outer diameter of said enhanced grommet and having a generally squarish profile and a first grommet length enabling the grommet to snugly seat within the end cap internal ring groove, the innermost portion of the enhanced grommet being bulbous and comprising a convex nose aimed at the interior of the connector and a second length greater than said first length, and the grommet comprising a neck disposed between said nose and said outermost portion;

wherein said first length is approximately 90% of said second length;

wherein said nose comprises a radius dimensioned approximately 20% of said first length;

wherein an annular void exists between said post and said body in which the coaxial cable outer conductive braid is restrained between said post and said body and electrically conductively contacted by said post;

wherein the end cap is frictionally attached by compressively axially deflecting said end cap towards said nut such that it will lock along said shank, and wherein the coaxial cable end is axially restrained after end cap compression within said connector substantially by compression and deformation of said enhanced sealing grommet, with an uninsulated portion of the cable center conductor extending through said nut thereby forming the male part of the resulting electrical connection and, a travel limiting stop ring defined on said body comprising external tactile regions that are sensed by touch, thus aiding in the manual assembly and positioning of the connector both before and after assembly.

2. The F-connector as defined in claim 1 wherein, when the connector is compressed, the body shank contacts the neck of the enhanced sealing grommet to squeeze and compress the sealing grommet to force the grommet into sealing contact with the coaxial cable.

3. The F-connector as defined in claim 1 wherein the tactile regions comprise a plurality of convex projections defined upon said body.

4. The F-connector as defined in claim 3 wherein the end cap comprises an external ring groove defined adjacent said terminal end, and a resilient external O-ring is seated within said external ring groove to aid the tactile regions by stimulating the sense of touch of an installer.

5. A compressible F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow post having a flanged end mechanically coupled to said nut and a reduced diameter trailing end adapted to be inserted into said prepared cable end around the center conductor insulation and coaxially beneath said outer conductive braid;

a hollow tubular body coaxially disposed over said post, the body having a rear end and a front end disposed adjacent said nut, said body comprising an external travel limiting stop ring and an integral, elongated tubular shank disposed between said stop ring and said rear end, said shank comprising a smooth, cylindrical outer surface that is free of obstructions extending from said ring to said rear end, and the body having an internal passageway with a diameter greater than the diameter of said post such that an annular void is formed between said post and said body;

a tubular end cap comprising an open end and a terminal end, the end cap comprising a smooth hollow interior, and the end cap adapted to be slidably coupled to said body shank rear end and variably positioned as desired by a user, the end cap comprising an interior passageway through which coaxial cable may pass, and an internal ring groove adjacent the terminal end;

an enhanced, generally toroidal sealing grommet disposed within said internal ring groove within said end cap, the enhanced sealing grommet comprising innermost and outermost portions that are integral and coaxial, the outermost portion forming the outer diameter of said enhanced grommet and having a generally squarish profile establishing a first grommet length enabling the grommet to snugly seat within the end cap internal ring groove, the innermost portion of the enhanced grommet comprising a convex nose aimed at the interior of the connector and a second grommet length, and the grommet comprising a neck disposed between said nose and said outermost portion;

wherein an annular void exists between said post and said body in which the coaxial cable outer conductive braid is restrained between said post and said body and electrically conductively contacted by said post;

wherein the end cap is frictionally attached by compressively axially deflecting said end cap towards said nut such that it will lock at any position along the cylindrical outer surface of said shank without assuming a predetermined detented position, and wherein the coaxial cable end is axially restrained after end cap compression within said connector substantially by compression and deformation of said enhanced sealing grommet, with an uninsulated portion of the cable center conductor extending through said nut thereby forming the male part of the resulting electrical connection.

6. The F-connector as defined in claim 5 wherein said first length is approximately 90% of said second length.

7. The F-connector as defined in claim 6 wherein said nose comprises a radius dimensioned approximately 20% of said first length.

8. The F-connector as defined in claim 7 wherein, when the connector is compressed, the body shank contacts the neck of the enhanced sealing grommet to squeeze and compress the sealing grommet to force the grommet into sealing contact with the coaxial cable.

9. The F-connector as defined in claim 8 wherein the hollow interior of the tubular end cap includes teeth means for frictionally gripping the outer surface of said body shank.

10. The F-connector as defined in claim 9 wherein the travel limiting stop ring on said body is provided with external tactile regions that are sensed by touch, thus aiding in the manual assembly and positioning of the connector both before and after assembly.

11. The F-connector as defined in claim 5 wherein, when the connector is compressed, the body shank contacts the neck of the enhanced sealing grommet to squeeze and compress the enhanced sealing grommet to force the grommet into sealing contact with the coaxial cable.

12. The F-connector as defined in claim 11 wherein the tactile regions comprise a plurality of convex projections defined upon said body.

13. The F-connector as defined in claim 12 wherein the end cap comprises an external ring groove defined adjacent said terminal end, and a resilient O-ring is seated within said ring groove to aid the tactile regions by stimulating the sense of touch of an installer.

* * * * *